US010738788B2

(12) United States Patent
Park et al.

(10) Patent No.: US 10,738,788 B2
(45) Date of Patent: Aug. 11, 2020

(54) BLOWER

(71) Applicant: LG ELECTRONICS INC., Seoul (KR)

(72) Inventors: Heechul Park, Seoul (KR); Myungjin Ku, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 397 days.

(21) Appl. No.: 15/653,650

(22) Filed: Jul. 19, 2017

(65) Prior Publication Data

US 2018/0023579 A1 Jan. 25, 2018

(30) Foreign Application Priority Data

Jul. 20, 2016 (KR) ..... 10-2016-0092154

(51) Int. Cl.
*F04D 25/08* (2006.01)
*F04D 17/16* (2006.01)
(Continued)

(52) U.S. Cl.
CPC ..... *F04D 25/08* (2013.01); *F04D 17/162* (2013.01); *F04D 25/062* (2013.01); *F04D 25/166* (2013.01); *F04D 27/004* (2013.01); *F04D 27/005* (2013.01); *F04D 29/002* (2013.01); *F04D 29/38* (2013.01); *F04D 29/424* (2013.01); *F04D 29/5826* (2013.01);
(Continued)

(58) Field of Classification Search
CPC ..... F04D 25/08; F04D 27/004; F04D 29/002; F04D 29/38; F04D 25/062; F04D 17/162; F04D 25/166; F04D 27/005; F04D 29/424; F04D 29/5826; F04D 29/703; F04D 25/0613; F04D 25/0646; F04D 29/547
USPC ..... 310/62
See application file for complete search history.

(56) References Cited

U.S. PATENT DOCUMENTS 4,738,188 A 4/1988 Nishida
5,893,705 A * 4/1999 Khan ..... F04D 17/105 417/354
(Continued)

FOREIGN PATENT DOCUMENTS

EP 1 775 524 4/2007
EP 1 950 500 7/2008
(Continued)

OTHER PUBLICATIONS

Korean Office Action dated May 17, 2017 issued in Application No. 10-2016-0092154.
(Continued)

*Primary Examiner* — Michael Andrews
(74) *Attorney, Agent, or Firm* — Ked & Associates LLP

(57) ABSTRACT

A blower is provided that may include a first suction inlet having a first suction opening formed therein; a second suction inlet having a second suction opening formed therein; at least one fan provided between the first suction inlet and the second suction inlet, to generate a flow of air; a discharge ring provided at an outer side of the at least one fan to discharge air to an outside of the blower; a filter provided at any one of the first suction inlet or the second suction inlet, to filter suctioned air; and a heater provided at the other of the first suction inlet or the second suction inlet, to heat suctioned air.

13 Claims, 21 Drawing Sheets

(51) Int. Cl.

| | |
|---|---|
| ***F04D 29/70*** | (2006.01) |
| ***F24F 7/007*** | (2006.01) |
| ***F04D 25/16*** | (2006.01) |
| ***F04D 27/00*** | (2006.01) |
| ***F04D 29/58*** | (2006.01) |
| ***F04D 29/42*** | (2006.01) |
| ***F04D 25/06*** | (2006.01) |
| ***F04D 29/00*** | (2006.01) |
| ***F04D 29/38*** | (2006.01) |
| *F04D 29/54* | (2006.01) |

(52) U.S. Cl.
CPC ..... *F04D 29/703* (2013.01); *F24F 7/007* (2013.01); *F04D 25/0613* (2013.01); *F04D 25/0646* (2013.01); *F04D 29/547* (2013.01); *F24F 2221/38* (2013.01)

(56) References Cited

U.S. PATENT DOCUMENTS

| | | | | |
|---|---|---|---|---|
| 6,011,331 | A * | 1/2000 | Gierer | H02K 29/06 310/52 |
| 6,209,622 | B1 | 4/2001 | Lagace et al. | |
| 7,156,611 | B2 * | 1/2007 | Oosawa | F04D 29/646 415/68 |
| 8,061,411 | B2 * | 11/2011 | Xu | H01L 23/3672 165/121 |
| 2003/0026600 | A1 | 2/2003 | Delonghi | |
| 2008/0101920 | A1 * | 5/2008 | Yoshida | F04D 25/0613 415/68 |
| 2009/0114377 | A1 | 5/2009 | Zheng et al. | |
| 2009/0317240 | A1 | 12/2009 | Wei | |
| 2016/0108928 | A1 | 4/2016 | Son et al. | |

FOREIGN PATENT DOCUMENTS

| | | |
|---|---|---|
| EP | 3 009 752 | 4/2016 |
| JP | H02-041049 | 3/1990 |
| KR | 20-1986-0013533 | 11/1986 |
| KR | 20-0278255 | 5/2002 |
| KR | 10-0838891 | 6/2008 |
| KR | 10-2008-0087365 | 10/2008 |
| KR | 10-2014-0095245 | 8/2014 |
| KR | 10-2016-0034058 | 3/2016 |
| WO | WO 2016/028034 | 2/2016 |

OTHER PUBLICATIONS

U.S. Appl. No. 15/654,383, filed Jul. 19, 2017, Devon C. Kramer.
U.S. Appl. No. 15/653,650, filed Jul. 19, 2017.
U.S. Appl. No. 15/654,383, filed Jul. 19, 2017.
Korean Office Action dated Jun. 14, 2017 issued in Application No. 10-2016-0092661.
European Search Report dated Nov. 29, 2017 issued in Application No. 17182168.9.
European Search Report dated Nov. 30, 2017 issued in Application No. 17182183.8.
U.S. Office Action dated Jul. 25, 2019 issued in U.S. Appl. No. 15/654,383.

* cited by examiner

BLOWER

CROSS-REFERENCE TO RELATED APPLICATION(S)

The present application claims priority under 35 U.S.C. 119 and 35 U.S.C. 365 to Korean Patent Application No. 10-2016-0092154, filed in Korea on Jul. 20, 2016, which is hereby incorporated by reference in its entirety.

BACKGROUND

1. Field

A blower is disclosed herein.

2. Background

In general, a blower is an apparatus that suctions air and blows the air to a position desired by a user. The blower is generally disposed in an indoor space, such as a house or office, to blow air to a user in hot weather such as summer. Therefore, the blower is generally used to cool off the user.

A typical blower generally includes a supporting part and a blowing part. A related art document related to the typical blower is Korean Patent Laid-Open Publication No. 10-2008-0087365 (hereinafter "related art document"), published on Oct. 1, 2008 and entitled "Electric fan", which is hereby incorporated by reference. The typical blower includes a body having a motor mounted therein, a blade coupled to the motor to be rotatably installed at the body according to an operation of the motor, and a supporting part provided at a lower portion of the body to support the body.

In addition, a first safety cover and a second safety cover are coupled to a front of the body to which the motor is coupled such that the blade is disposed between the first safety cover and the second safety cover. The first safety cover and the second safety cover allow a user to not be in direct contact with the rotating blade.

Accordingly, if the motor in the body is driven, the typical blower blows air to the user as the blade rotates. The blower may have the same configuration as blowers widely used.

However, the related art blower has the following problems. First, as the typical blower generally discharges cool air, the blower cannot be used in a winter season. Second, when the blower is driven in a space having a high pollution level, harmful substances, such as fine dust, are discharged together with the discharged air, and thus, do harm to the health of the user.

BRIEF DESCRIPTION OF THE DRAWINGS

Embodiments will be described in detail with reference to the following drawings in which like reference numerals refer to like elements, and wherein.

DETAILED DESCRIPTION

Figure 1:
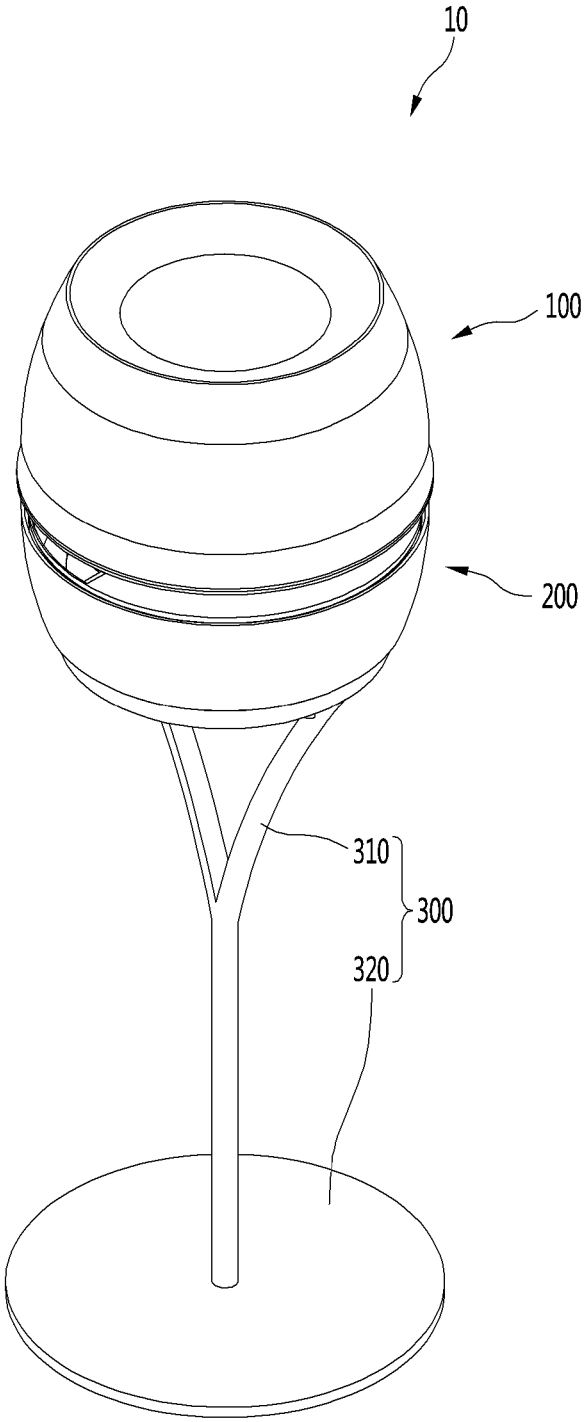
FIG. 1 is a perspective view of a blower according to an embodiment.
Figure 2:
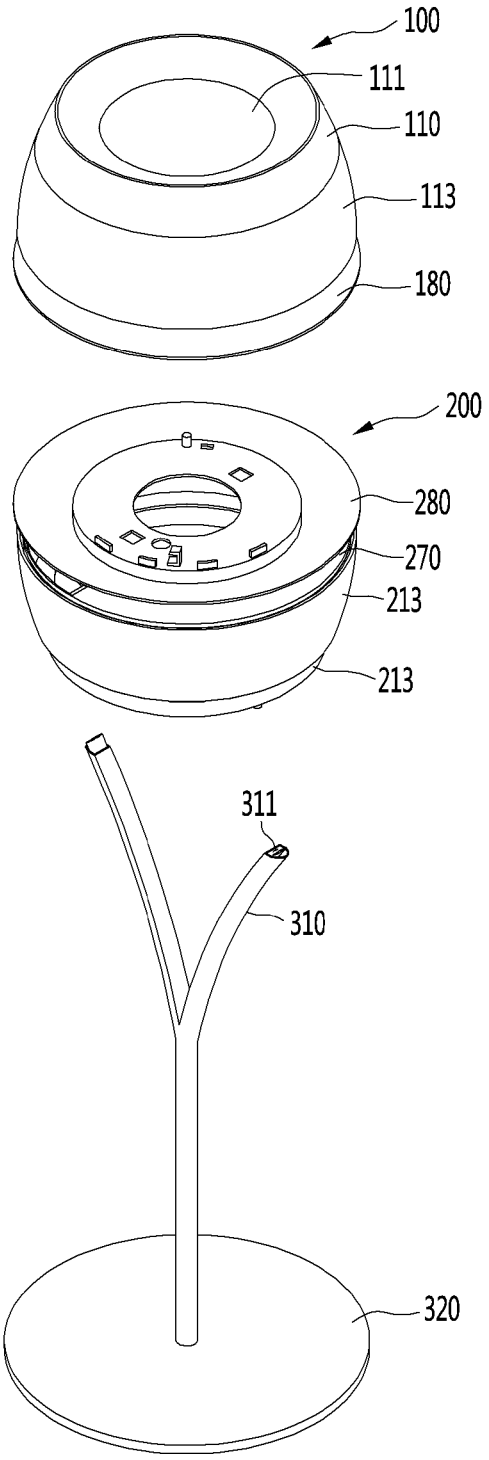
FIG. 2 is an exploded view of the blower according to the embodiment.
Figure 3:
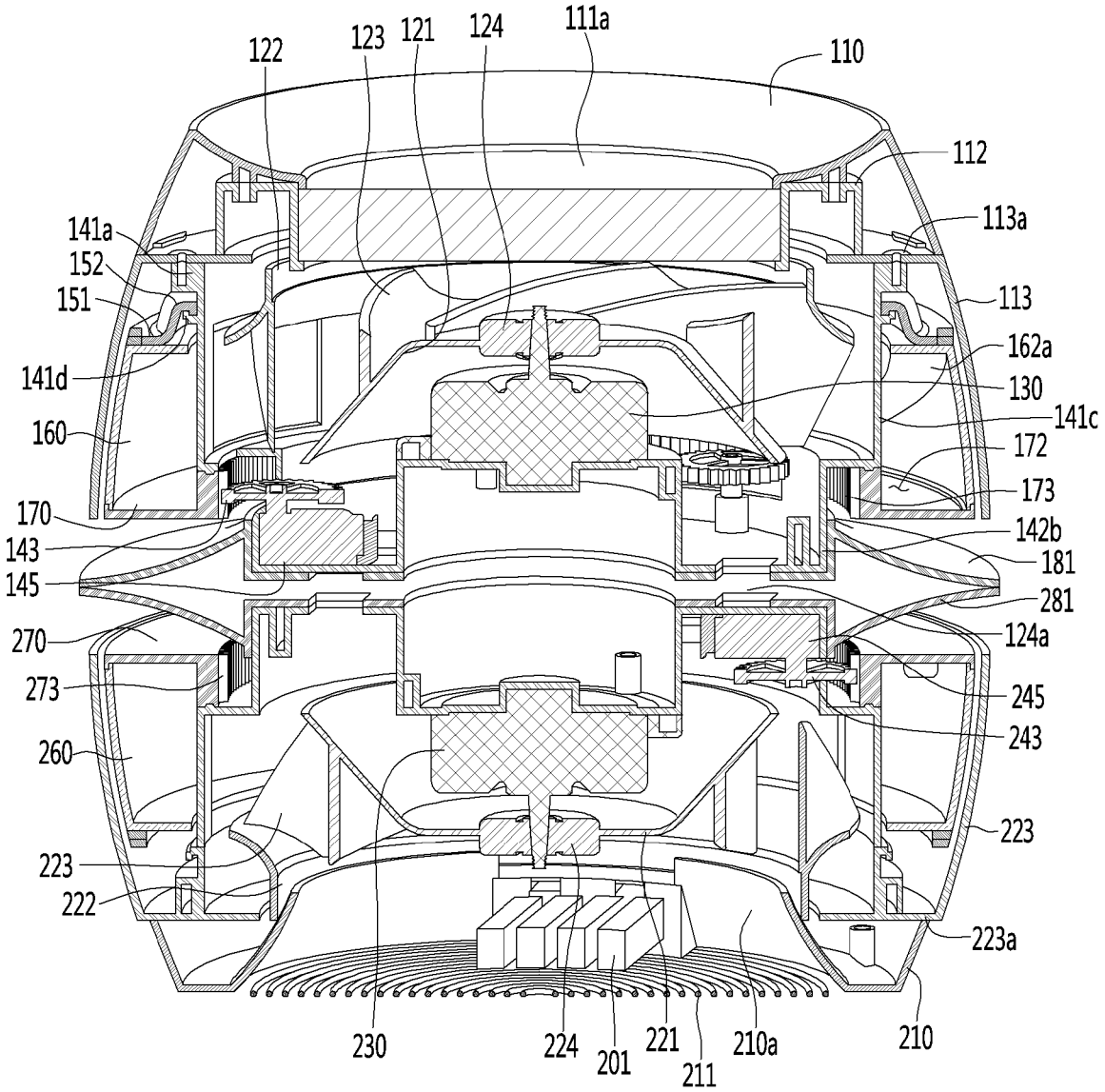
FIG. 3 is a sectional view of a body of the blower according to an embodiment.
Figure 4:
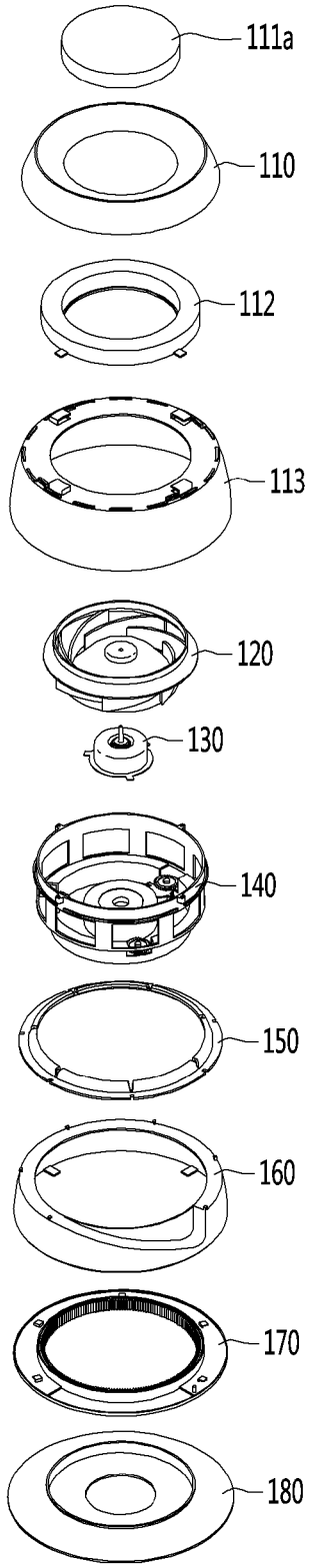
FIG. 4 is an exploded view of a first blower according to an embodiment.
Figure 5:
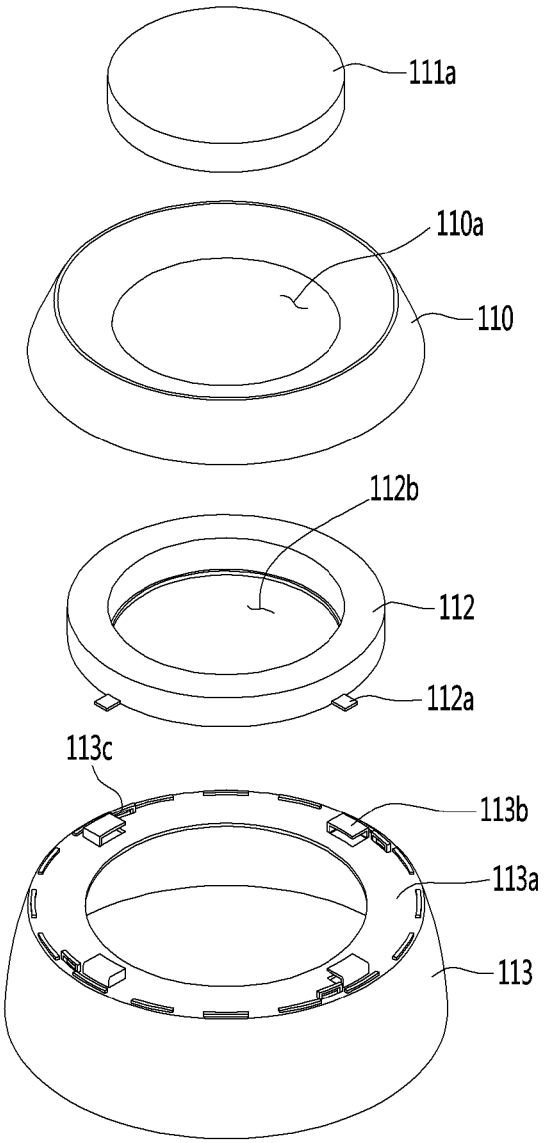
FIG. 5 is an exploded view of an upper suction inlet and a first case according to an embodiment.
Figure 6:
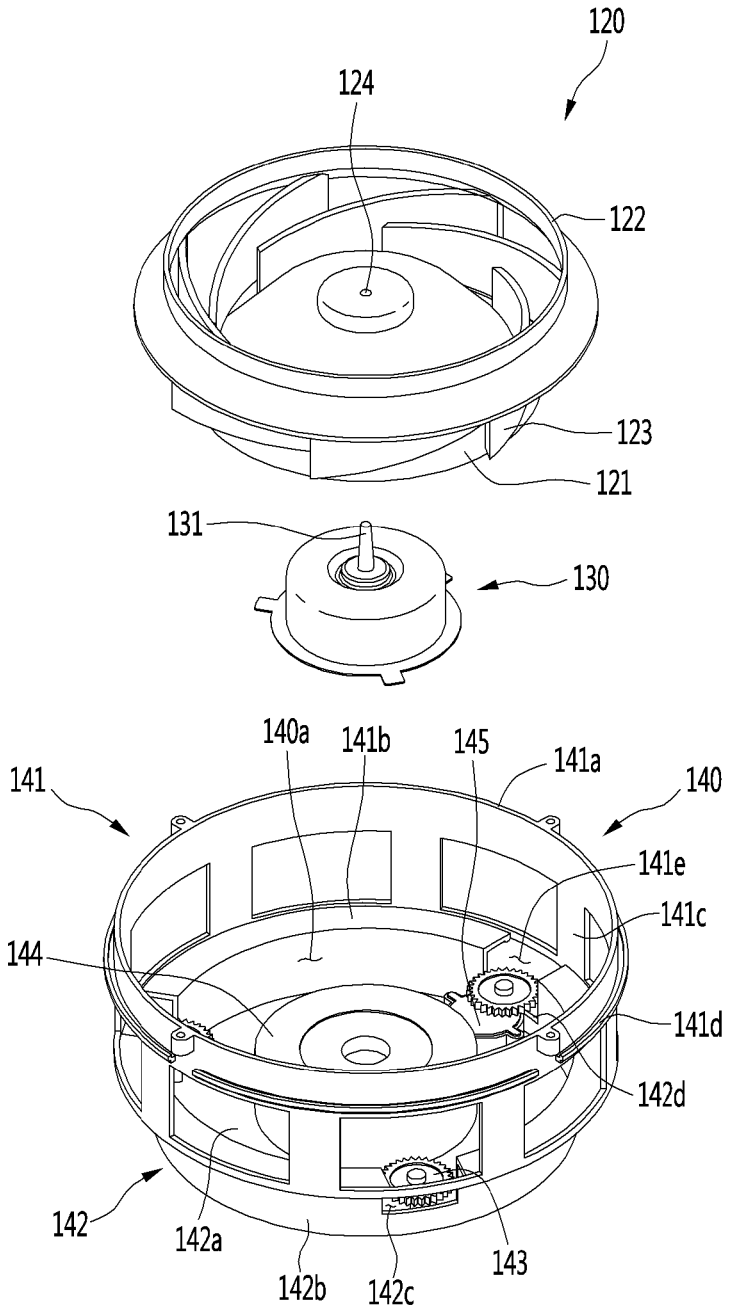
FIG. 6 is an exploded view of a first flow generating portion according to an embodiment.
Figure 7:
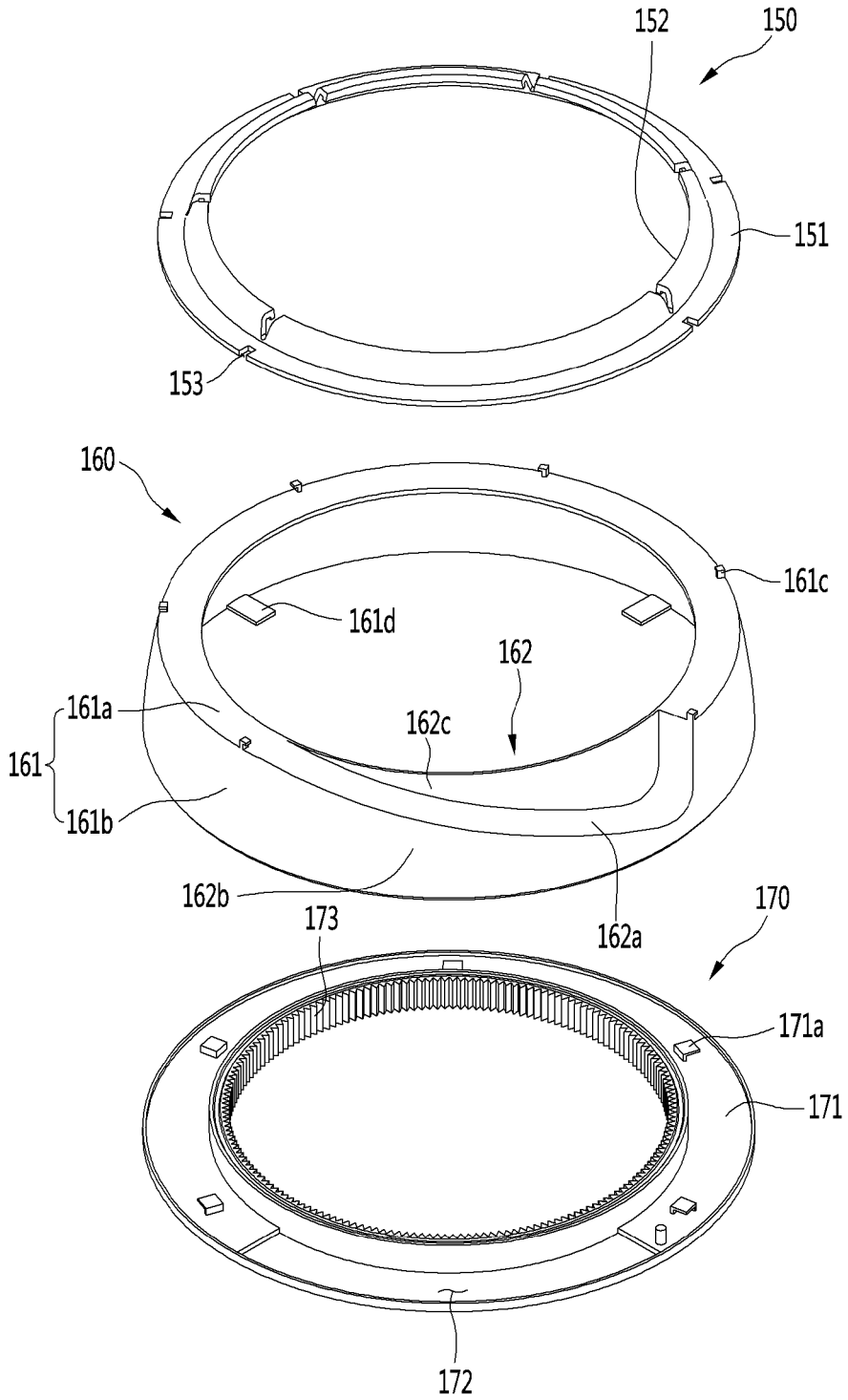
FIG. 7 is an exploded view of a first discharge guide according to an embodiment.
Figure 8:
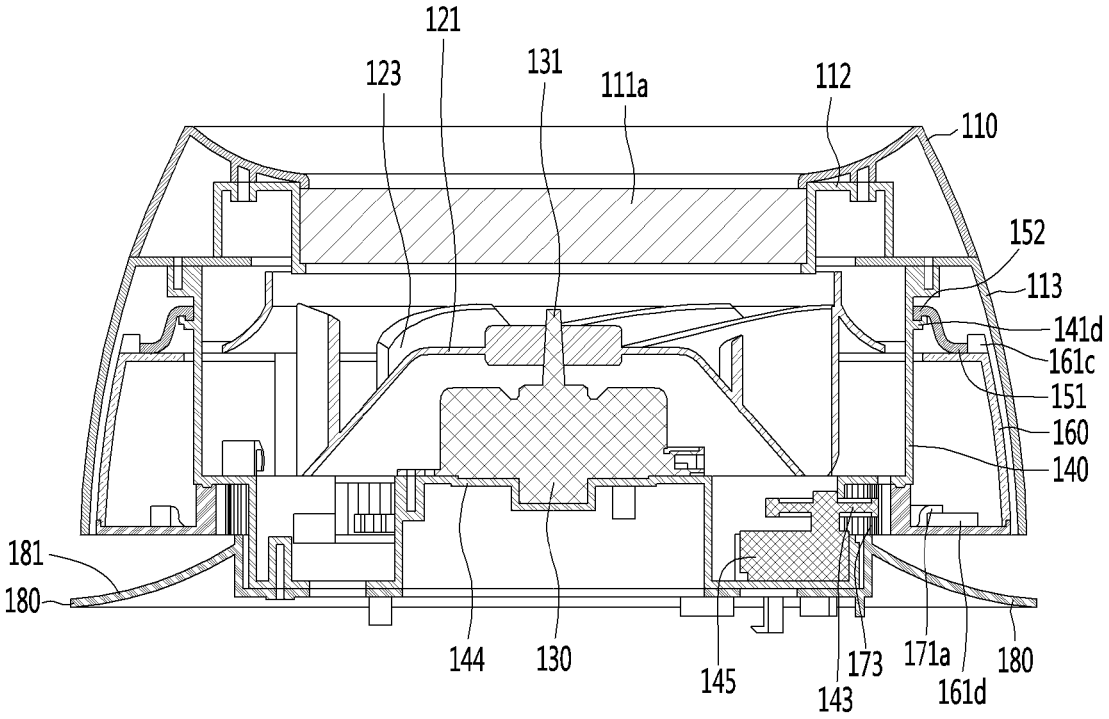
FIG. 8 is a sectional view of the first blower according to an embodiment.
Figure 9:
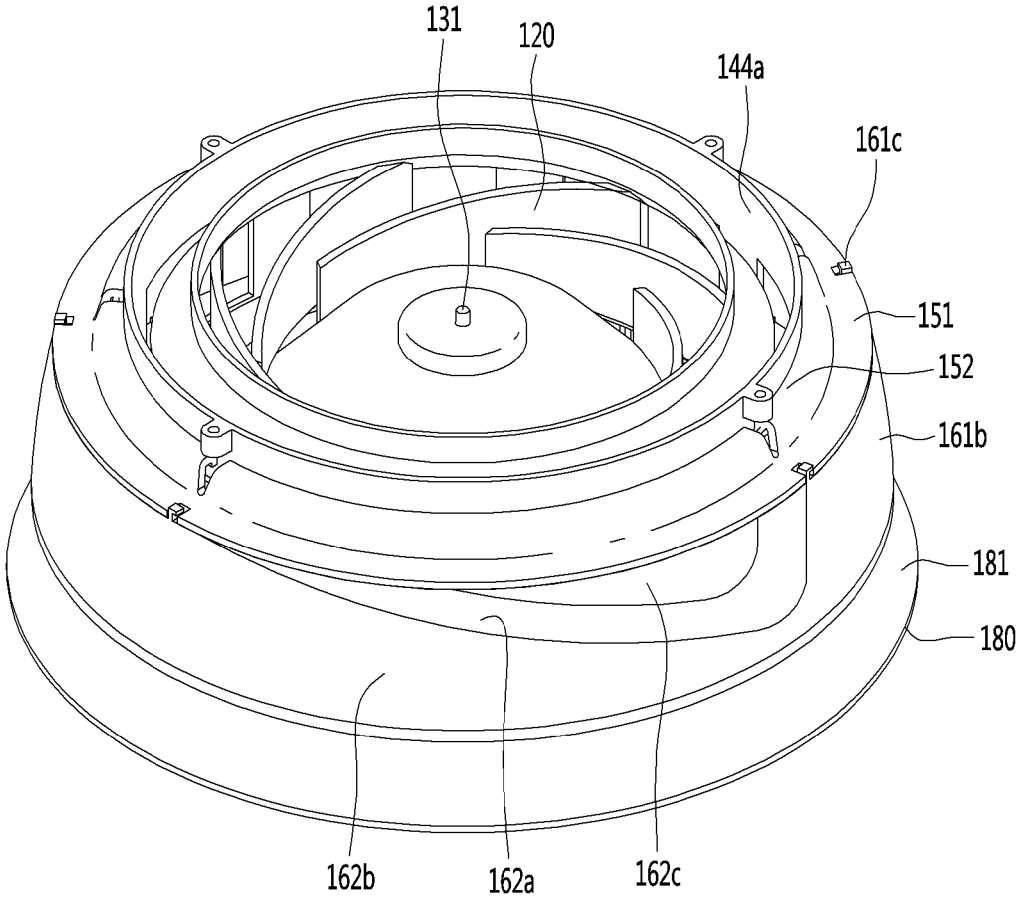
FIG. 9 is a perspective view illustrating when the first case and the upper suction inlet are removed from the first blower according to an embodiment.

Referring to FIGS. 1 and 2, the blower according to an embodiment may include a body 10 that generates a flow of air and a supporting part or support (or stand) 300 that supports the body 10. The body 10 may include a first blower (or first blower shell) 100 that generates a first air current A (see FIG. 21) and a second blower (or second blower shell) 200 that generates a second air current B (see FIG. 21).

The first blower 100 and the second blower 200 may be arranged in an vertical direction. In one embodiment, the first blower 100 may be provided at an upper side of the second blower 200. The first air current A may be an air current including indoor air at an upper side of the body 10, that is, an upper side of the first blower 100, suctioned into the first blower 100 and then discharged to an outside of a first end of the first blower 100. The second air current B may be an air current including indoor air at a lower side of the body 10, that is, a lower side of the second blowing device 200 suctioned into the second blower 200 and then discharged to an outside of a first end of the second blower 200.

The first blower 100 and the second blower 200 may be vertically symmetrical to each other with respect to a same central axis, and may be rotatable with respect to the central axis. The central axis may be a virtual line that connects centers of the first blower 100 and the second blower 200.

However, the central axis is merely a virtual line set for directions, and is not a component having an actual shape.

The first blower 100 and the second blower 200 may have a same shape. In this case, the first blower 100 and the second blower 200 may be symmetrical to each other with respect to a vertical central axis.

The first blower 100 may generate the first air current A by suctioning indoor air at the upper side of the body 10 and discharging the suctioned air at a lower end of the first blower 100 in a first discharge direction, and the second blower 200 may generate the second air current B by suctioning indoor air at the lower side of the body 10 and discharging the suctioned air at an upper end of the first blower 200 in a second discharge direction. The discharge direction of the first air current A and the discharge direction of the second air current B may be identical to or different from each other depending on rotation directions of the first blower 100 and the second blower 200.

For example, if the first blower 100 and the second blower 200 are rotated in a first direction, the discharge direction of the first air current A and the discharge direction of the second air current B may be identical to each other. That is, when the discharge direction of the first air current A is a frontward direction with respect to the body 10, the discharge direction of the second air current B may also be the frontward direction.

Figure 21:
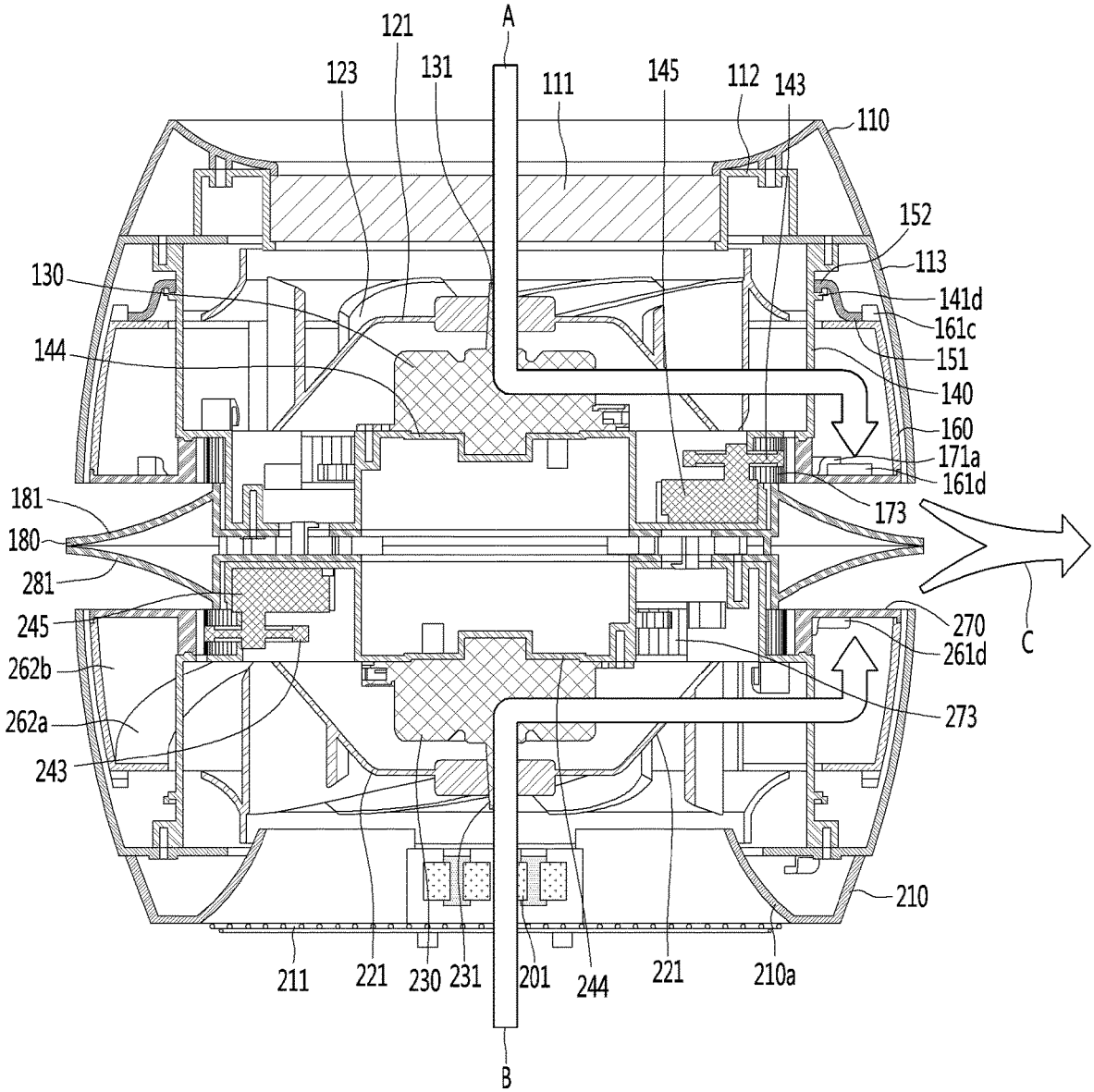
FIG. 21 is a view showing air currents generated in the blower according to an embodiment.

The first air current A and the second air current B may also be joined together to form a third air current C (see FIG. 21). The third air current C may be referred to as a "discharge air current" of the first and second air currents A and B. A vertical direction of the discharge air current may be determined according to discharge intensities of the first air current A and the second air current B. This will be described hereinafter.

As another example, if the first blower 100 is rotated in the first direction and the second blower 200 is rotated in a second opposite direction, the discharge direction of the first air current A and the discharge direction of the second air current B may be different from each other, that is, directions opposite to each other. That is, when the discharge direction of the first air current A is a frontward direction with respect to the body 10, the discharge direction of the second air current B may be a rearward direction.

The support 00 may be provided at the lower side of the body 10 to support the body 10. The support 300 may include a first supporting part or support (or leg) 310 which may be connected to the lower side of the body 10 to support the body 10, and a plate-shaped second supporting part (or base) 320 which may be connected to a lower end of the first support 310 and be arranged horizontally with respective to ground.

The first support 310 may extend from the body 10 to the second support 320. The first support 310 may have a shape of a Y-shaped pipe. An upper portion of the Y-shaped pipe may be connected to a lower end of the body 10, and a lower portion of the Y-shaped pipe may be connected to the second support 320.

A wire accommodating space 311 having a wire accommodated therein may be formed in the first support 310. For example, a plurality of the wire may be provided. The first support 310 may be a pipe having the wire accommodating space 311 formed therein, and the wire(s) connected to the body 10 may be introduced into the second support 320 through an internal space of the first support 310. The plurality of wires may connect the body 10 to a controller. A configuration of the controller will be described hereinafter.

The second support 320 may be connected to the lower end of the first support 310 to be mounted horizontally with respect to ground, thereby supporting the body 10. That is, the second support 320 may serve as a base horizontal to the ground.

The controller that controls an operation of the body 10 may be accommodated in the second support 320. One end of the plurality of wires may be connected to the body 10 to be provided in the wire accommodating space 311 of the first support 310, and the other end of the plurality of wires may be introduced into the second support 320 to be connected to the controller provided in the second support 320. According to this connection structure, the plurality of wires may connect the body 10 to the controller. That is, in the blower according to the embodiment, the controller and the wires may be accommodated in the support 300, so that the size of the body 10 may remain compact.

Referring to FIGS. 3 to 9, the body 10 may include the first blower 100 and the second blower 200 as described above. The first blower 100 may suction air from the upper side of the body and discharge the suctioned air at the lower end thereof in the first discharge direction.

The first blower 100 may include a first suction inlet, which may also be referred to as an upper suction part or inlet 110 which may be provided at an upper portion of the first blower 100 to enable indoor air at an upper side thereof to be suctioned therethrough. The upper suction inlet 110 may include a first suction opening 110*a* which may be formed in an approximately ring shape to allow air to be suctioned therethrough. In addition, an upper portion of the upper suction inlet 110 may have a diameter smaller than a diameter of a lower portion of the upper suction inlet 110. That is, the upper suction inlet 110 may have a truncated cone shape.

A height of an outer circumferential surface of the upper suction inlet 110 may be greater than a height of an inner circumferential surface of the upper suction inlet 110. That is, an extension line extending from the outer circumferential surface to the inner circumferential surface of the upper suction inlet 110 may be rounded downward. Accordingly, air at an upper side of the first blower 100 may flow along a rounded inclined surface of the upper suction inlet 110, and thus, a suction force of the upper suction inlet 110 may be increased.

In addition, a filter device 111 may be provided at a lower side of the upper suction inlet 110. The filter device 111 may include a filter mounting part or mount or bracket 112 which may be provided at a lower side of the upper suction inlet 110 and have a mounting hole 112*b*, and a filter 111*a* which may be provided in the filter mounting hole 112*b* to filter the first air current.

The filter mount 112 may have an approximately ring shape such that the mounting hole 112*b* is formed at a central portion thereof. The mounting hole 112*b* may have a diameter equal to or greater than a diameter of the first suction opening 110*a* of the upper suction inlet 110. An outer circumferential surface of the filter 111*a* may have a cylindrical shape having a diameter corresponding to a diameter of the mounting hole 112*b*, to be inserted and coupled into the mounting hole 112*b*.

Air introduced from the upper side of the first blower 100 may penetrate toward a lower surface from an upper surface of the filter 111*a* provided in the first suction opening 110*a*. In this process, fine dust or foreign substances contained in the air may be filtered by the filter 111*a*. That is, as the filter 111*a* is provided in the first suction opening 110*a* of the upper suction inlet 110, air introduced through the upper suction inlet 110 may be filtered by the filter 111*a*, so that the filtered air may be discharged from the first blower 100.

The filter 111*a* may include a pre-filter, a HEPA filter, or a deodorization filter, or a filter unit in which the filters are combined as one. However, the kind of the filter 111*a* is not limited thereto.

A plurality of first protruding ribs 112*a* protruding in a radial direction from a center of the filter mount 112 may be formed at an outer circumferential surface of the filter mount 112. The plurality of first protruding ribs 112*a* may be spaced apart from each other at a certain distance along the outer circumferential surface of the filter mount 112. The plurality of first protruding ribs 112*a* may each be coupled to a first bending rib 113*b* formed at an upper surface 113*a* of a first case 113, which will be described hereinafter.

The first blower 100 may further include the first case 113 which may be coupled to a lower portion of the upper suction inlet 110, thereby forming an outer appearance of the first blower 100. The first case 113 may have an approximately ring shape. An upper portion of the first case 113 may have a diameter equal to a diameter of the lower portion of the upper suction inlet 110. In addition, a lower portion of the first case 113 may have a diameter greater than a diameter of the upper portion.

The first case 113 may include the upper surface 113*a* and a lower surface, which may be formed to have a certain width between outer and inner circumferential surfaces thereof. A lower surface of the upper suction inlet 110 may be coupled to the upper surface 113*a* of the first case 113, so that the upper suction inlet 110 and the first case 113 may have an integrated shape. In addition, an extension line extending from an upper portion to a lower portion of the first case 113 may have a predetermined curvature.

A plurality of first bending ribs 113*b* may be formed at the upper surface 113*a* of the first case 113. The plurality of bending ribs 113*b* may be respectively coupled to the plurality of first protruding ribs 112*a* formed at the filter mount 112.

The first bending rib 113*b* may have a "¬" shape. To allow the filter mount 112 to be coupled to the first case 113, if the filter mount 112 is placed on the upper surface 113*a* of the first case 113 and then rotated, the first protruding rib 112*a* may be coupled to the first bending rib 113*b*.

A plurality of second protruding ribs 113*c* may be formed at the upper surface 113*a* of the first case 113, and a plurality of first coupling grooves to which the plurality of second protruding ribs 113*c* may be respectively coupled may be formed in the lower surface of the upper suction inlet 110. As the plurality of second protruding ribs 113*c* are respectively inserted and coupled into the plurality of first coupling grooves, the upper surface 113*a* of the case 113 and the lower surface of the upper suction inlet 110 may be coupled to each other.

A first flow generating part or may be provided at an inner circumferential surface of the first case 113. The first flow generating portion may be a means that generates a flow in which air is suctioned toward the upper suction inlet 110, and a flow in which air is discharged to a first discharge guide device or guide, which will be described hereinafter.

The first flow generating portion may include a rotating upper fan 120, an upper fan motor 130 that transfers a rotational force to the upper fan 120, and an upper fan housing 140 in which the upper fan 120 and the upper fan motor 130 may be accommodated. The upper fan motor 130 may be coupled to the upper fan housing 140 to transfer a drive to the upper fan 120. The upper fan motor 130 may include a rotational shaft coupled to the upper fan 120 to rotate the upper fan 120. The configuration of the upper fan motor 130 is not limited as long as the upper fan motor 130 is a motor generally coupled to a fan.

The upper fan 120 may be coupled to the upper fan motor 130 to be rotated. For example, the upper fan 120 may be a centrifugal fan by which air is introduced in an axial direction and discharged toward a lower side in the radial direction. The upper fan 120 may include a hub 121 coupled to a rotational shaft 131 of the upper fan motor 130, a shroud 122 spaced apart from the hub 121, and a plurality of blades 123 provided between the hub 121 and the shroud 122.

The hub 121 may have a bowl shape having a width which gradually narrows in an upward direction. Also, the hub 121 may include a shaft coupling part or portion 124 through which the rotational shaft 131 may be coupled to the hub 121, and a first blade coupling part or portion extending downward from the shaft coupling portion 124. The upper fan motor 130 may be provided in a lower internal space of the hub 121, and the rotational shaft 131 of the upper fan motor 130 may be coupled to the shaft coupling portion 124 of the hub 121.

The shroud 122 may include an upper end part or end provided with a shroud suction hole through which air passing through the upper suction inlet 110 may be suctioned, and a second blade coupling part or portion extending downwardly from the upper end. One or a first surface of each of the plurality of blades 123 may be coupled to the first blade coupling portion of the hub 121, and the other or a second surface of each of the plurality of blades 123 may be coupled to the second blade coupling portion of the shroud 122. The plurality of blades 123 may be spaced apart from each other in the circumferential direction of the hub 121.

Each blade 123 may include a leading edge that forms a side end portion or end at which air is introduced, and a trailing edge that forms a side end portion at which air is discharged. Air which is suctioned through the upper suction inlet 110 and passes through the filter 111*a* may flow downwardly, be introduced at the leading edge by flowing in the axial direction of the upper fan 120, and be discharged at the trailing edge via the blade 123. In this case, the trailing edge may be downwardly and outwardly inclined with respect to the axial direction, corresponding to the flow direction of the air, so that the air discharged by the trailing edge may flow downwardly at an incline in the radial direction.

The upper fan housing 140 may include a first coupling fan housing 142 in which the upper fan 120 and the upper fan motor 130 may be accommodated, and a first side fan housing 141 provided at an upper portion of the first coupling fan housing 142. An accommodating space 140*a* in which the upper fan 120 and the upper fan motor 130 may be accommodated may be defined by the first side fan housing 141 and the first coupling fan housing 142.

The first side fan housing 141 may include a ring-shaped first upper surface part or first upper surface 141*a* provided at an upper portion thereof, a ring-shaped first lower surface part or surface) 141*b* provided at a lower portion thereof, and a plurality of first extension parts or extensions 141*c* that extend between the first upper surface 141*a* and the first lower surface 141*b*. The first upper surface 141*a* may be formed in a ring shape to have a surface vertical to the ground. That is, the first upper surface 141*a* may have a cylindrical shape having open upper and lower ends.

A second bending rib 141*d* extending by a predetermined length in the circumferential direction may be provided at an outer circumferential surface of the first upper surface 141*a*.

The second bending rib 141*d* may have a " " shape that protrudes in an outer radial direction of the first upper surface 141*a* and is then bent upward. Also, the second bending rib 141*d* may extend in the circumferential direction of the first upper surface 141*a*. According to this configuration, a guide supporting device or support 150, which will be described hereinafter, may be rotated when coupled to the second bending rib 141*d* of the first upper surface 141*a*.

The first extension 141*c* may vertically extend toward the first lower surface 141*b* from the first upper surface 141*a*, and have a plate shape. Also, a plurality of the first extension 141*c* may be provided spaced apart from each other along the circumferential direction of the first side fan housing 141.

The lower surface 141*b* may include a first lower surface body formed in a ring shape to have a surface horizontal to the ground, and a first recessed part or first recess 141*e* recessed in the radial direction at an inner circumferential surface of the first lower surface body. A plurality of the first recess 141*e* may be provided spaced apart from each other at a certain distance in the circumferential direction of the first lower surface body.

The first coupling fan housing 142 may be connected to a lower portion of the first side fan housing 141, and have a cylindrical shape having an open upper portion. The first coupling fan housing 142 may include a first side surface part or surface 142*b*, a second lower surface part or surface 142*a*, and an upper fan motor coupling part or portion 144.

The first side surface 142*b* may extend downward from the first lower surface 141*b* of the first side fan housing 141. The first side surface 142*b* may have a ring shape having a surface vertical to the ground, and include a first side surface body extending downwardly from an inner circumferential surface of the first lower surface 141*b*, and a second recessed part or recess 142*c* recessed downwardly at an upper end of the first side surface part body.

A plurality of the second recess 142*c* may be provided spaced apart from each other at a certain distance along the circumferential direction of the first side surface body. The first recess 141*e* and the second recess 142*c* may vertically communicate with each other, to form a communicating space. Through the communicating space, a first pinion gear 143, which will be described hereinafter, may be partially exposed to an outside of the upper fan housing 140.

The first side surface body may include a first pinion gear coupling surface 142*d* extending from a lower end of the second recess 142*c*, to be coupled to the first pinion gear 143, which will be described hereinafter. The first pinion gear coupling surface 142*d* may have a surface parallel to the first lower surface body.

If the first pinion gear 143 is coupled to the first pinion gear coupling surface 142*d*, a portion of the first pinion gear 143 may protrude to an outside of the first side surface body of the upper fan housing 140 through the communicating space of the first recess 141*e* and the second recess 142*c*. The first pinion gear 143 may be coupled to the first pinion gear coupling surface 142*d*. The first pinion gear 143 may be engaged with a first rack gear 173 of a first discharge part or outlet 170, which will be described hereinafter. An operation of the first pinion gear 143 will be described hereinafter.

For example, three first recessed parts or recesses 141*e* and three second recessed parts or recesses 142*c* may be radially arranged based on a center of the upper fan housing 140. In this case, three first pinion gears 143 may also be provided in each of corresponding first and second recesses, respectively. The three first pinion gears 143 may be arranged in a circular pattern such that the circle has a center identical to a center of a circle which is an upper end surface of the upper fan housing 140, and be provided at vertex positions of a regular triangle having vertices on a circumferential surface of the circle which is the upper end surface of the upper fan housing 140.

The second lower surface 142*a* may be connected to a lower end of the first side surface 142*b*, to form a lower surface of the upper fan housing 140. The upper fan motor coupling portion 144 may protrude upward from a central portion of the second lower surface 142*a*, and the upper fan motor 130 may be coupled to the upper fan motor coupling portion 144. A first gear motor 145 that transfers a drive force to rotate the first pinion gear 143 may be provided at the second lower surface 142*a*.

The first blower 100 may further include the first discharge guide provided between the first flow generating portion and the first case 113, to perform a rotary motion to guide the first air current A generated by the first flow generating portion and discharge the first air current A to the outside. The first discharge guide may include a first flow guide part or guide 160 that guides a flow of air generated by the first flow generating portion, and the first discharge outlet 170 provided at a lower side of the first flow guide 160 to discharge air guided by the first flow guide 160. The first discharge guide may be rotatably connected to the first flow generating portion, to be rotated in the circumferential direction.

The first flow guide 160 may have a ring shape. A diameter of an upper end of the first flow guide 160 may be smaller than a diameter of a lower end of the first flow guide 160. That is, the first flow guide 160 may have a truncated cone shape.

The first flow guide 160 may guide air discharged by the upper fan 120. The first flow guide 160 may include a first flow path part or path 161 that provides a path through which air generated by the first flow generating portion flows, and a first guide flow path 162 that guides a flow of air in an inclined lower direction from the first flow path 161.

The first flow path 161 may have a C shape in which a portion of the ring shape is cut out. The first flow path 161 may have a side surface 161*b* forming an outer appearance thereof and an upper surface 161*a* bent toward a center of the first flow guide 160 from an upper end of the side surface 161*b*. A flow path through which air may flow may be formed in a space between the side surface 161*b* and the upper surface 161*a* of the first flow path 161.

The first guide flow path 162 may be provided at the cut-out portion of the first flow path 161. The first guide flow path 162 may include a first inclined surface 162*a* inclined to be rounded downward from the upper surface 161*a* of the first flow path part 161, and a first guide connecting part or surface 162*b* that extends from the side surface 161*b* of the first flow path part 161 and is bent downward from a first end of the first inclined surface 162*a*. Also, the first guide flow path 162 may further include a second guide connecting part or surface 162*c* bent upwardly from the a second end of the first inclined surface 162*a*.

An inclined space formed by the first guide connecting surface 162*b*, the first inclined surface 162*a*, and the second guide connecting surface 162*c* may form an air flow path. That is, air flowing through the first flow path surface 161 may be guided to the first discharge outlet 170 through the flow path formed by the first guide connecting surface 162*b*, the first inclined surface 162*a*, and the second guide connecting surface 162*c*.

A third bending rib 161*c* may be formed at the upper surface 161*a* of the first flow path 161. The third bending rib

161*c* may be a component to which the guide supporting device 150, which will be described hereinafter may be coupled. The third bending rib 161*c* may have a "¬" shape, and may be provided at the upper surface 161*a* of the first flow path 161. A plurality of the third bending rib 161*c* may be provided, and the plurality of third bending ribs 161*c* may be spaced apart from each other at a certain distance along the circumferential direction of the first flow path 161.

A third protruding rib 161*d* protruding toward a center of the first flow path 161 may be formed at a lower end of the side surface 161*b* of the first flow path 161. The third protruding rib 161*d* may be a component to which a third flow path may be coupled. A plurality of the third protruding rib 161*d* may be provided, and the plurality of third protruding ribs 161*d* may be spaced apart from each other at a certain distance along the circumferential direction of the third flow path.

The first discharge outlet 170 may be provided at a lower side of the first flow guide 160, to discharge air guided from the first flow guide 160 to the outside. The first discharge outlet 170 may include a ring-shaped first discharge body 171 and the first rack gear 173 protruding upwardly from the first discharge body 171.

The first discharge body 171 may have a ring shape, and may include a first discharge port 172 formed to have a set or predetermined length in the circumferential direction. In this case, the predetermined length of the first discharge port 172 may be approximately equal to a length of the first guide flow path 162. Air guided through the first guide flow path 162 of the first flow guide 160 may be discharged downwardly through the first discharge port 172.

A fourth bending rib 171*a* may be formed at an upper surface of the first discharge body 171. The fourth bending rib 171*a* may be bent in a "¬" shape, and a plurality of the fourth bending rip 171*a* may be provided. The plurality of fourth bending ribs 171*a* may be spaced apart from each other at a certain or predetermined distance along the circumferential direction of the first discharge body 171. If the first flow guide 160 is mounted on the first discharge body 171 and then rotated, the third protruding rib 161*d* at the lower end of the side surface 161*b* of the first flow path 161 may allow the first flow guide 160 to be coupled to the first discharge outlet 170 while being inserted into the fourth bending rib 171*a* of the first discharge body 171.

The first guide flow path 162 of the first flow guide 160 and the first discharge port 172 may be arranged vertically, so that the first guide flow path 162 and the first discharge port 172 may communicate with each other. Accordingly, the air guided through the first guide flow path 162 may be discharged to the outside through the first discharge port 172.

The first rack gear 173 may have a ring shape protruding upward from an inner circumferential surface of the first discharge body 171. A plurality of sawteeth extending in the circumferential direction of the first rack gear 173 and protruding toward a center of the first discharge body 171 may be provided at an inner circumferential surface of the first rack gear 173.

The first discharge guide may further include the guide support 150 that supports the first flow guide 160. The guide support 150 may have an approximately ring shape. The guide support 150 may be coupled to the first flow guide 160 and the upper fan housing 140 to support the first flow guide 160 such that the first flow guide 160 may be connected to the upper fan housing 140.

The guide support 150 may include a mounting part or rim 151 mounted on the first flow guide part 160, and a coupling part or lip 152 that extends upwardly from the mounting rim 151 and has an end part or end bent downwardly to be coupled to the upper fan housing 140. The mounting rim 151 may have a ring shape, and may include a lower surface mounted on an upper surface of the first flow guide 160. Also, the mounting rim 151 may have a plurality of second coupling grooves 153 spaced apart from each other along the circumferential direction.

If the guide support 150 is rotated after the mounting rim 151 is mounted on the upper surface of the first flow guide 160 such that the third bending rib 161*c* is inserted into the second coupling groove 153, the guide support 150 may be coupled to the upper surface of the first flow guide 160 as at least one portion of the mounting rim 151 is inserted into the third bending rib 161*c*. The coupling rim 152 may have a ring shape, and may protrude upwardly from the inner circumferential surface of the mounting rim 151 and then bent downwardly.

One side portion of the bent coupling rim 152 may include a hook. If the coupling rim 152 is coupled to the second bending rib 141*d*, the guide support 150 may be coupled to the upper fan housing 140. As an extending direction of the coupling rim 152 and an extending direction of the second bending rib 141*d* form a circumferential direction, the coupling rim 152 may be rotated along with the second bending rib 141*d* when the first flow guide 160 is rotated.

The first blower 100 may have a shape where a diameter is larger toward a first or lower portion as compared to a second or upper portion thereof. Therefore, the first discharge guide may be separated downwardly or deviated from an original position. Accordingly, the first discharge guide may be rotatably coupled to the upper fan housing 140 using the guide support 150, so that it is possible to prevent the first discharge guide from being separated downwardly or being deviated from the original position.

The first blower 100 may further include a first air current changing device or fin 180 which may be provided at a lower side of the first discharge guide, to change the flow of air discharged from the first discharge guide to a lateral direction. The first air current changing fin 180 may have a ring shape, and an upper surface of the first air current changing fin 180 may include an inclined surface inclined downward toward the outside. Thus, the flow of air discharged downward from the first discharge guide may be changed to the lateral direction by the inclined surface of the first air current changing fin 180.

Figure 10:
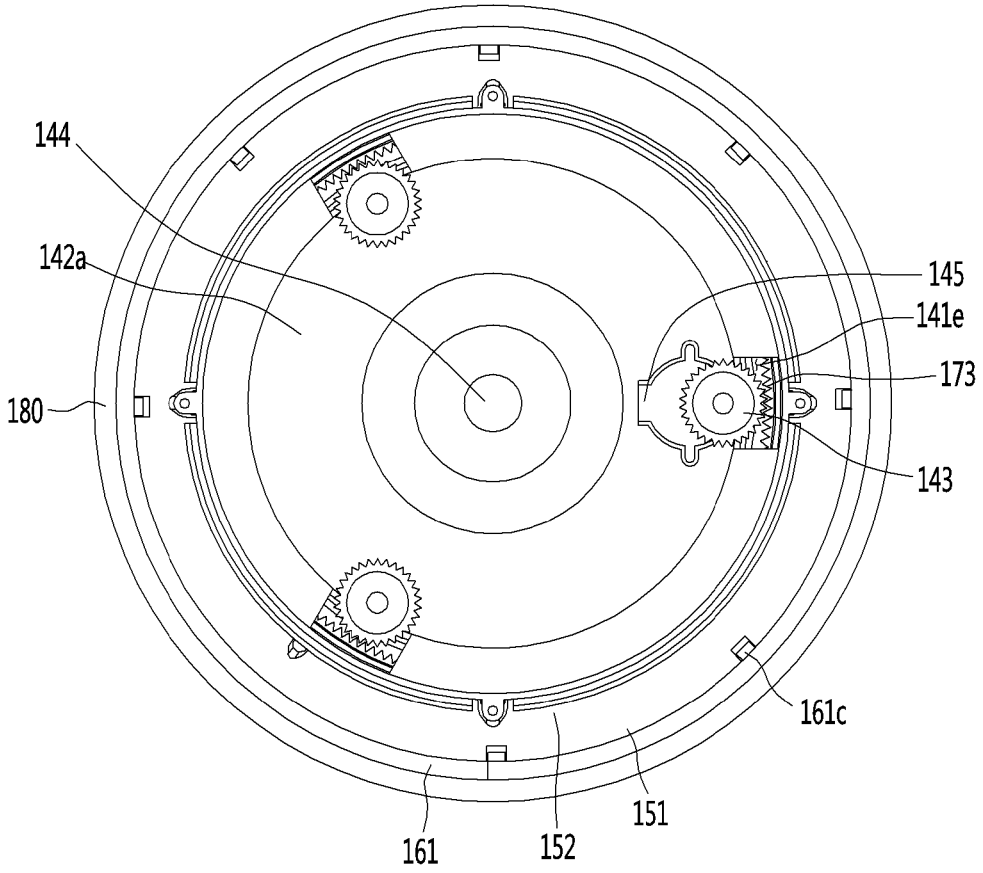
FIG. 10 is a top view showing a coupling state between a first pinion gear and a first rack gear of the first blower according to an embodiment.
Figure 11:
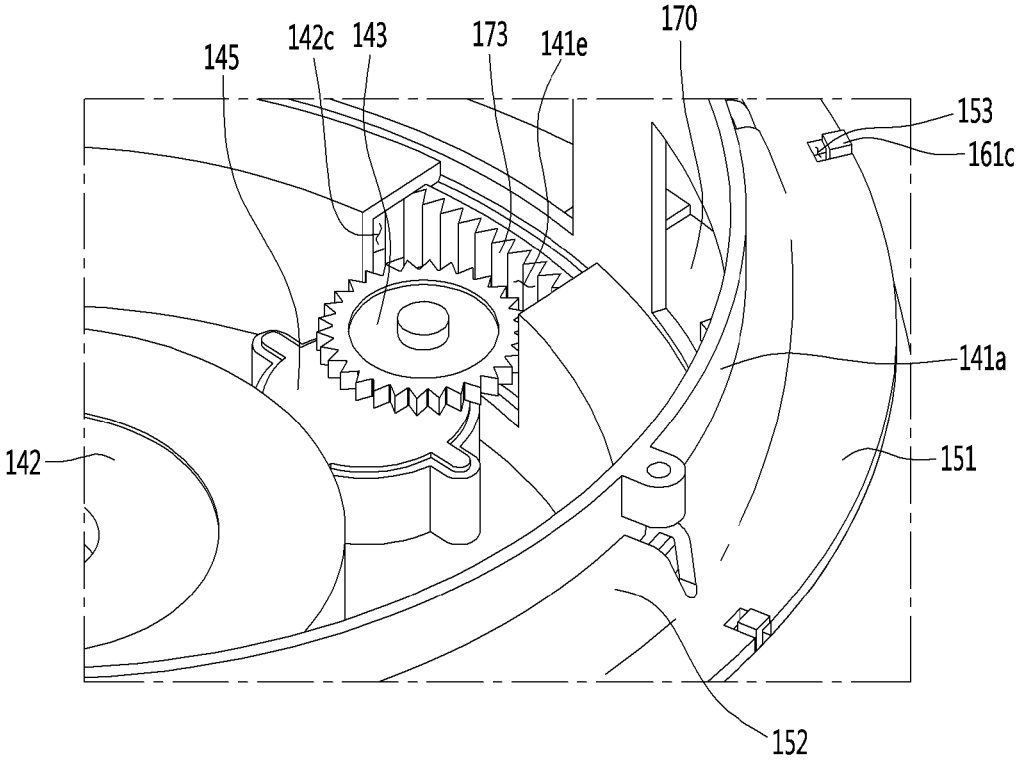
FIG. 11 is a perspective view showing the coupling state between the first pinion gear and the first rack gear of the first blower according to the embodiment.
Figure 12:
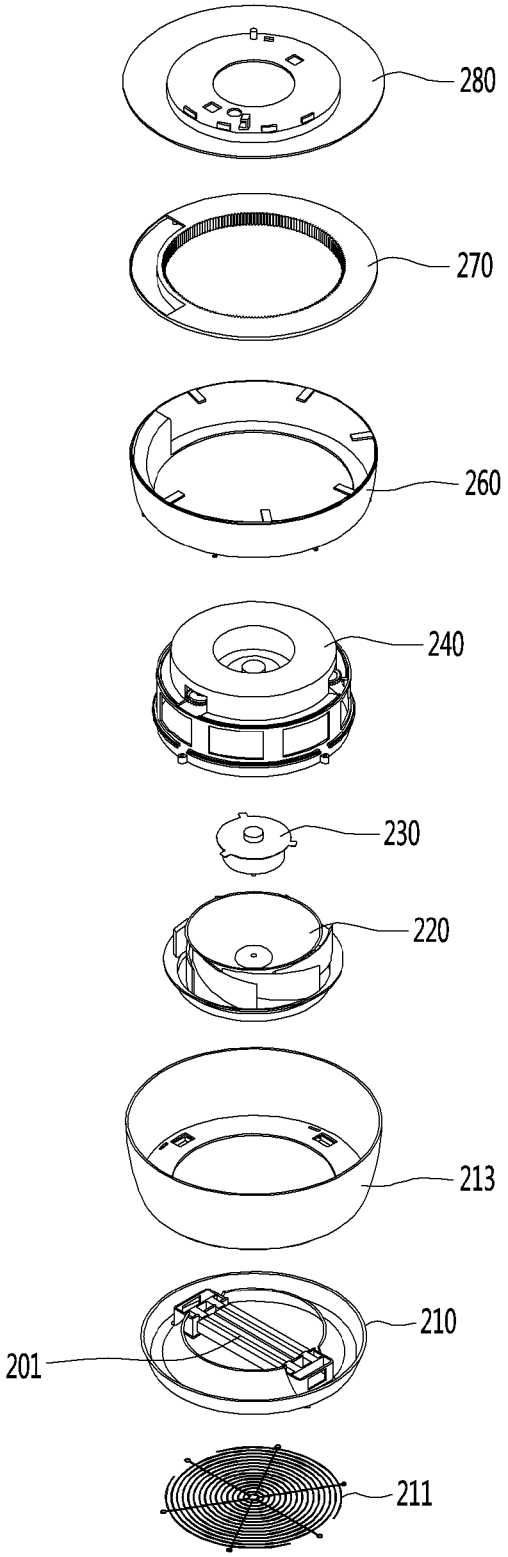
FIG. 12 is an exploded view of a second blower according to an embodiment.
Figure 13:
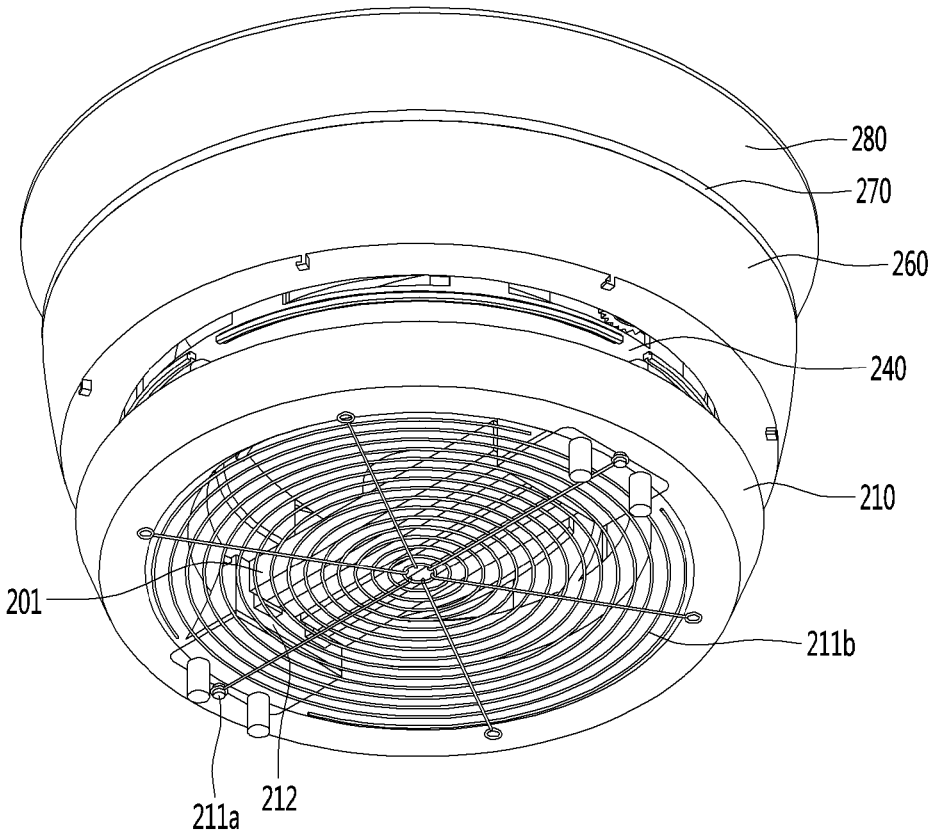
FIG. 13 is a perspective view illustrating when a second case is removed from the second blower.
Figure 14:
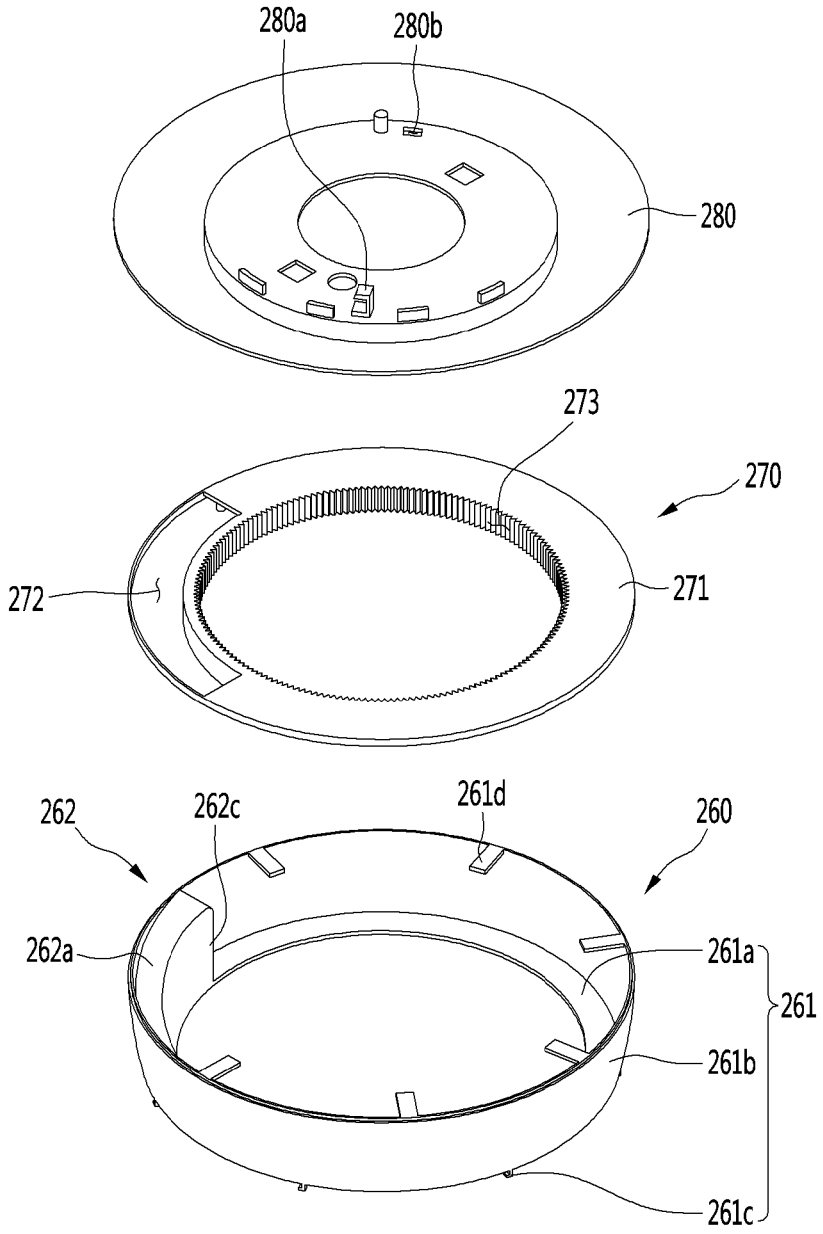
FIG. 14 is an exploded view of a second discharge guide and a second air current changing fin according to an embodiment.
Figure 15:
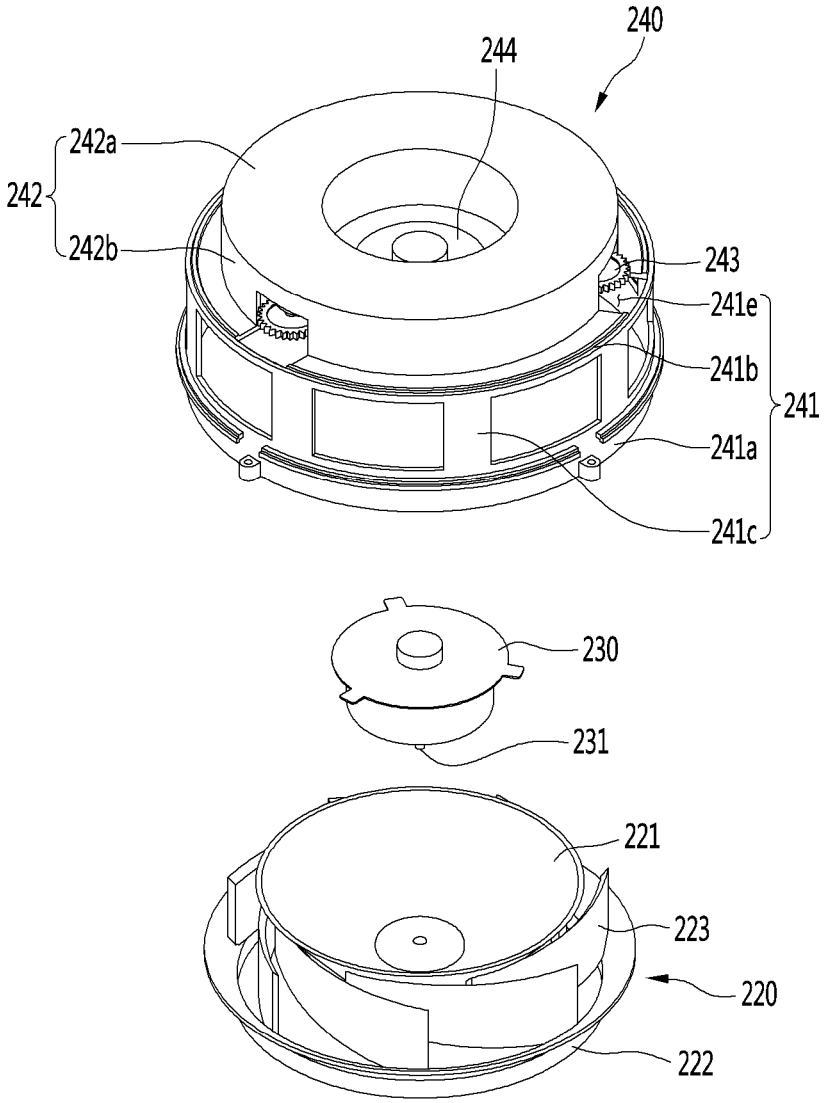
FIG. 15 is an exploded view of a second flow generating portion according to an embodiment.
Figure 16:
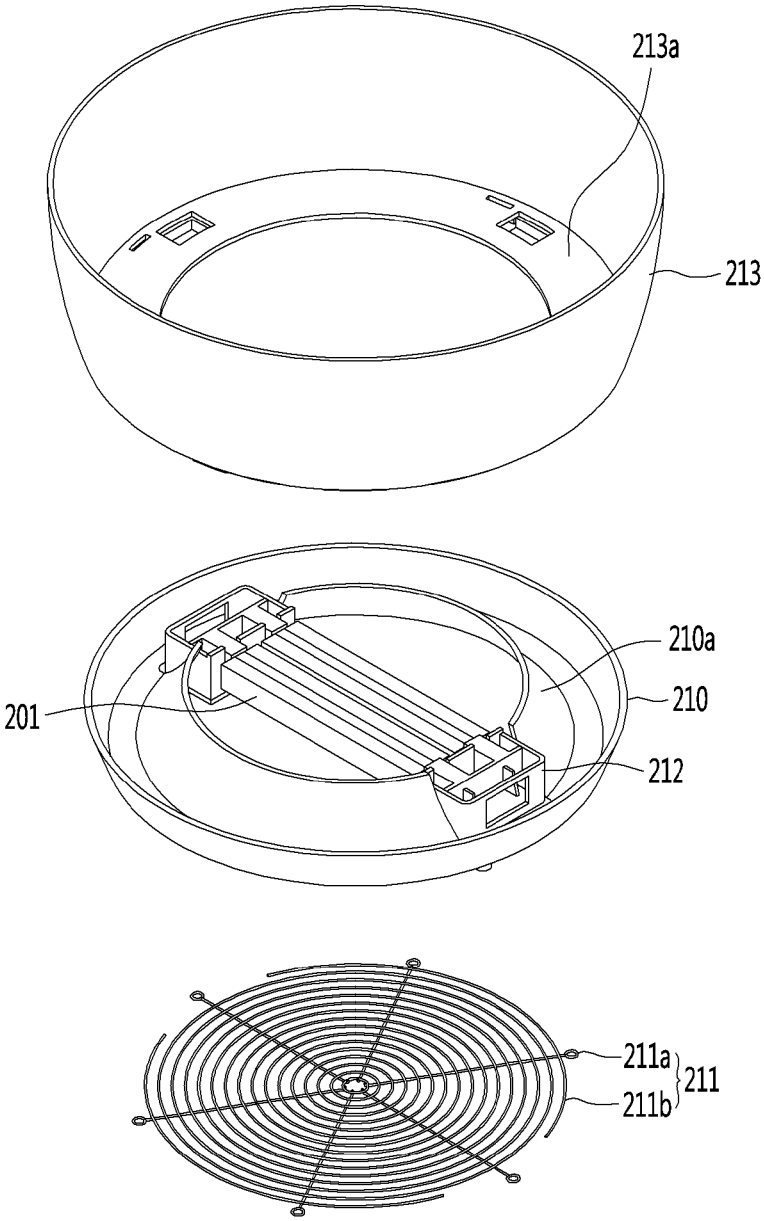
FIG. 16 is an exploded perspective view of a lower suction inlet and the second case according to an embodiment.
Figure 17:
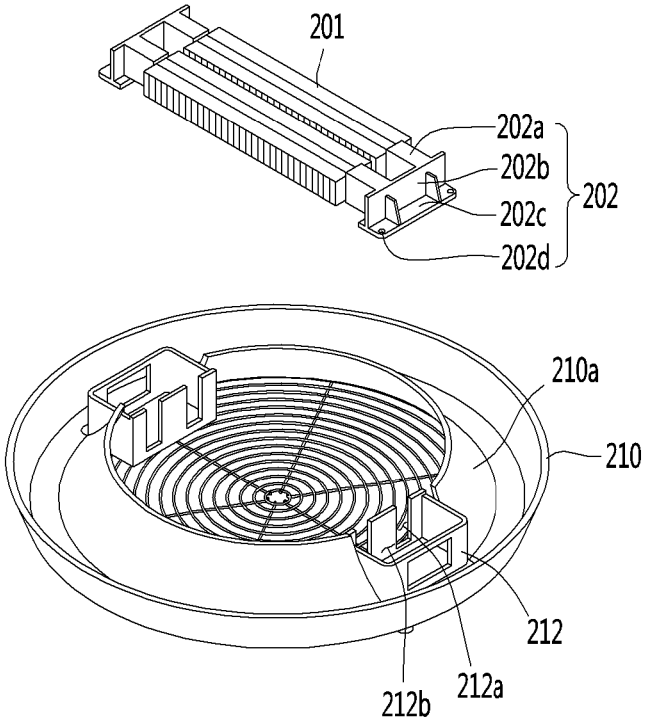
FIG. 17 is an exploded view of the lower suction inlet and the heater according to an embodiment.
Figure 18:
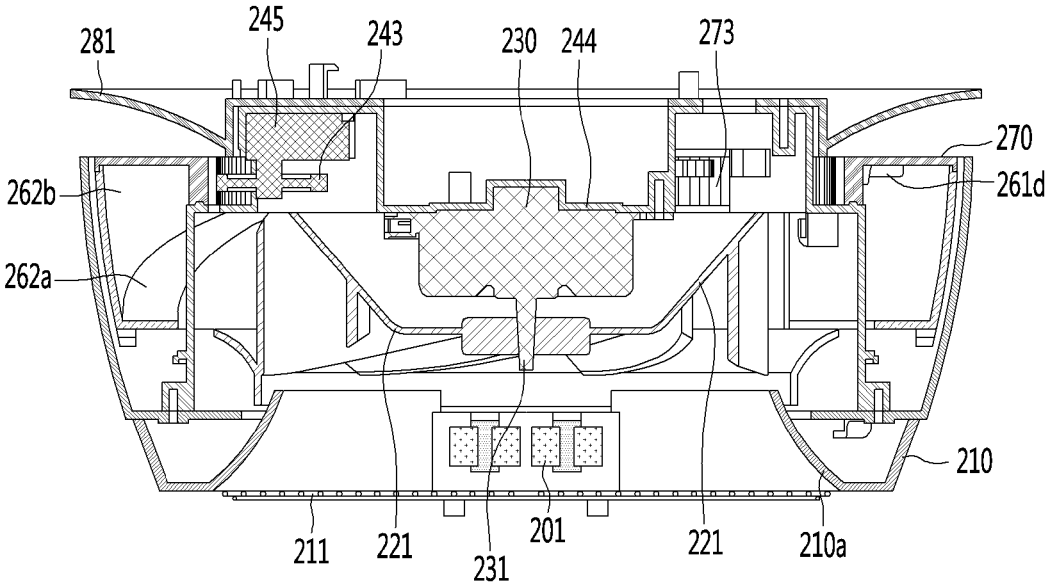
FIG. 18 is a sectional view of the second blower according to an embodiment.

Referring to FIGS. 10 and 11, the plurality of first pinion gears 143 coupled to the upper fan housing 140 may be exposed to the outside of the upper fan housing 140 through the first recesses 141*e* and the second recesses 142*c*. In addition, if the first discharge guide is coupled to the upper fan housing 140, the first rack gear 173 among the components of the first discharge guide may be gear-coupled to the first pinion gear 143.

If the first pinion gear 143 is rotated as the first gear motor 145 coupled to any one of the plurality of first pinion gears 143 is driven, the first rack gear 173 may be rotated by the first pinion gear 143. As the first rack gear 173 is rotated, the first discharge outlet 170 may be rotated, and the first flow guide 160 coupled to the first discharge outlet 170 may also be rotated.

The first flow guide 160 and the first discharge outlet 170 may be rotated by 360 degrees in the circumferential direction. Accordingly, air introduced through the upper suction inlet 110 may be discharged in the lateral direction along the rotation direction of the first flow guide 160 and the first discharge outlet 170.

Hereinafter, the second blower 200 will be described. The second blower 200 may have a shape obtained by overturning the first blower 100. That is, while the first blower 100 may have a truncated cone shape where a diameter is larger toward the lower portion compared to the upper portion thereof, the second blower 200 may have a truncated cone shape where a diameter is larger toward an upper portion from a lower portion thereof.

Referring to FIGS. 12 to 18, the second blower 200 may include a second suction inlet, which may also be referred as a lower suction part or inlet 210, a second flow generating part or portion, a second flow guide part or guide 260, and a second air current changing device or fin 280. The second blower 200 may suction air at the lower side of the body 10 and discharge the suction air at an upper end of the second blower 200 in the second discharge direction.

The lower suction inlet 210 may be provided at a lower portion of the second blower 200, and indoor air may be suctioned through the lower suction inlet 210. The lower suction inlet 210 may have an approximately ring shape, and include a second suction opening through which air is suctioned. A lower portion of the lower suction inlet 210 may have a diameter smaller than a diameter of an upper portion of the lower suction inlet 210.

A height of an outer circumferential surface of the lower suction inlet 210 may be greater than a diameter of an inner circumferential surface of the lower suction inlet 210. An extension surface 210*a* extending from the outer circumferential surface to the inner circumferential surface of the lower suction inlet 210 may be formed to be rounded upward.

A heater device or heater may be provided at the extension surface 210*a*. Heater mounting parts or mounts 212 to mount the heater may be provided at both sides of the extension surface 210, respectively. For example, both side portions of the heater may be inserted into the heater mounts 212, respectively, so that the heater may be coupled to the lower suction inlet 210.

The heater mounts 212 may be provided in grooves formed at both sides of the extension surface 210*a*, respectively. However, this is merely an example of a position, and the heater mounts 212 may be integrally formed with the extension surface 210*a*. A structure of the heater mounts 212 will be described hereinafter.

The heater may include at least one heat source 201 that generates heat, and fixing parts or brackets 202 respectively provided at both side portions of the heat source 201 to fix the heat source 201 to the lower suction inlet 210. The heat source 201 may have a bar shape, and a first end and a second end of the heat source 201 may be fixed to the fixing brackets 202, respectively. The heat source 201 may be a device that generates heat, and may include a cartridge heater, a band heater, or a coil heater, which is generally used, for example. However, the kind of heater is not limited thereto. Although a configuration in which two heat sources 201 are formed in a bar shape and are arranged parallel to each other is illustrated in the drawings, embodiments are not limited thereto, and a shape or number of heat sources 201 is not limited.

The fixing brackets 202 may include a first fixing part or protrusion 202*a* protruding in the extending direction of the heat source 201 from each of both ends of the heat source 201, a second fixing part or protrusion 202*b* extending perpendicular to the protruding direction of the first fixing part or protrusion 202*a*, and a third fixing part or protrusion 202*c* bent in the extending direction of the heat source 201 at a lower end of the second fixing protrusion 202*b*. At least one fastening hole 202*d* through which a screw, for example, can be fastened may be formed in the third fixing protrusion 202*c*.

The heater mount 212 formed at the extension surface 210*a* of the lower suction inlet 210 may have a box shape having an open upper side. A circumference of the heater mount 212 may be shielded, and a fastening space 212*b* in which the third fixing protrusion 202*c* may be mounted to be coupled to the fastening hole 202*d* may be formed in the heater mount 212. At least one insertion groove 212*a* may be formed in any one surface among shielding surfaces of the heater mount 212.

A width of the insertion groove 212*a* may be approximately equal to a width of the first fixing protrusion 202*a*. When the first fixing protrusion 202*a* of the fixing bracket 202 is inserted into the insertion groove 212*a*, the second fixing protrusion 202*b* and the third fixing protrusion 202*c* may be inserted into the fastening space 212*b*, and the fixing bracket 202 may be coupled to the heater mount 212. A predetermined fastening member may be fastened to the fastening hole 212*d*, so that the fixing bracket 202 may be fixed to the heater mount 212. Thus, the heater may be fixed to the lower suction inlet 210.

Air introduced into the lower suction inlet 210 may be heated by the heat source 201 of the heater. The heated air may be discharged through a second discharge port 272 of a second discharge body 271, so that a user may be exposed to warm air through the blower even a winter season.

A grill 211 may be provided in the second suction opening of the lower suction inlet 210. The grill 211 may radially extend from the center of the lower suction part 210. The grill 211 may include a plurality of first grills 211*a* coupled to a lower surface of the lower suction inlet 210, and a plurality of circular second grills 211*b* connected to the plurality of first grills 211*a*.

The grill 211 may be formed of a metallic material. The grill 211 may be heated together with the heater, to uniformly heat air introduced into the lower suction inlet 210. As the heater and the grill 211 are provided at the lower suction inlet 210, the user may not drive the heater in hot weather, such as in summer, to enable cool air to be discharged, and may drive the heater in cold weather, such as winter, to enable warm air to be discharged.

A second case 213 may be connected to an upper portion of the lower suction inlet 210 to form an appearance of the second blower 200. The second case 213 may have an approximately ring shape, and a lower diameter of the second case 213 may be approximately equal to an upper diameter of the lower suction inlet 210. An upper portion of the second case 213 may have a diameter greater than a diameter of a lower portion of the second case 213. The second case 213 may have a shape obtained by overturning the first case 113. An extension line extending from the upper portion to the lower portion along an outer edge of the second case 213 may have a predetermined curvature.

The second flow generating portion may be provided at an inner circumferential surface of the second case 213. The second flow generating portion may generate a flow pattern by which air is suctioned toward the lower suction inlet 210 and the second air current B discharged to a second discharge guide, which will be described hereinafter.

The second flow generating portion may have a shape obtained by overturning the first flow generating portion. The second flow generating portion may include a rotating lower fan 220, a lower fan motor 230 that transfers a rotational force to the lower fan 220, and a lower fan housing 240 in which the lower fan 220 and the lower fan motor 230 may be accommodated.

The lower fan motor 230 may include a rotational shaft coupled to the lower fan housing 240, and may transfer a drive force to the lower fan 220. A configuration of the lower fan motor 230 may be similar to a configuration of the upper fan motor 130, and therefore, detailed description thereof has been omitted.

The lower fan 220 may be rotatably coupled to the lower fan motor 230. For example, the lower fan 220 may include a centrifugal fan that receives air in an axial direction and discharges the air to an upper side in the radial direction.

The lower fan 220 may include a hub 221 coupled to the rotational shaft of the lower fan motor 230, a shroud 222 spaced apart from the hub 221, and a plurality of blades 223 provided between the hub 221 and the shroud 222. A configuration of the lower fan 220 may be similar to a configuration of the upper fan 120, and therefore, detailed description thereof has been omitted.

Air passing through the heater from a lower side through the lower suction inlet 210 may flow in the axial direction of the lower fan 220 while flowing upwardly, and may flow toward an upper side in the radial direction via the plurality of blades 223. The lower fan housing 240 may include a second coupling fan housing 242 in which the lower fan 220 and the lower fan motor 230 may be accommodated, and a second side fan housing 241 provided at a lower portion of the lower fan housing 240.

The second coupling fan housing 241 may have a structure identical to that obtained by overturning the first coupling fan housing 142, and the second side fan housing 241 may have a structure identical to that obtained by overturning the first side fan housing 141. In addition, an accommodating space in which the lower fan 220 and the lower fan motor 230 may be accommodated may be defined by the second coupling fan housing 242 and the second side fan housing 241.

The second coupling fan housing 242 may include a second upper surface part or surface 242*a*, a second side surface part or surface, and a lower fan motor coupling part or portion 244. The second upper surface 242*a*, the second side surface, and the lower fan motor coupling portion 244 may have structures identical to those obtained by overturning the second lower surface 142*a*, the first side surface 142*b*, and the upper fan motor coupling 144 of the first coupling fan housing 142, respectively, and therefore, repetitive descriptions have been omitted.

The second side fan housing 241 may include a third upper surface part or surface 241*b*, a third lower surface part or surface 241*a*, and a second extension part or extension 241*c*. The third upper surface 241*b*, the third lower surface 241*a*, and the second extension 241*c* may have structures identical to those obtained by overturning the first lower surface 141*b*, the first upper surface 141*a*, and the first extension 141*c* of the first side fan housing 141, respectively, and therefore, repetitive descriptions have been omitted.

However, for convenience of description, a second pinion gear 243 may be provided at a position of the lower fan housing 240, corresponding to a position of the upper fan housing 140, at which the first pinion gear 143 is provided. A second gear motor 245 that drives the second pinion gear 243 may be connected to the second pinion gear 243.

The second blower 200 may further include a second discharge guide device or guide provided between the second flow generating portion and the second case 213, and that performs a rotary motion to guide the flow of air generated by the second flow generating portion and discharge the air to the outside. The second discharge guide may include the second flow guide 260 which guides a flow of air generated by the second flow generating portion, and a second discharge part or outlet 270 provided at an upper side of the second flow guide 260 to discharge the guided air to the outside. The second discharge guide may be rotatable along the circumferential direction.

Shapes of the second flow guide 260 and the second discharge outlet 270 may be identical to those obtained by overturning the first flow guide 160 and the first discharge outlet 170. The second flow guide 260 may include a second flow path part or path 261 and a second guide flow path 262. The second flow path 261 and the second guide flow path 262 may have structures identical to those obtained by overturning the first flow path 161 and the first guide flow path 162, and therefore, repetitive descriptions have been omitted.

The second discharge outlet 270 may include the second discharge body 271 having the second discharge port 272 formed therein and a second rack gear 273. The second discharge body 271 and the second rack gear 273 may have structures identical to those obtained by overturning the first discharge body 171 and the first rack gear 173, respectively, and therefore, repetitive descriptions have been omitted.

The second discharge guide may not include components of the guide support 150 among the components of the first discharge guide. This is because, while an entire appearance of the first blower 100 has a shape where the diameter is larger at a lower portion compared to an upper portion of the first blower 100, an entire appearance of the second blower 200 has a shape where the diameter is smaller at a lower portion compared to an upper portion of the second blowing device 200. Hence, the second flow guide 260 in the second blower 200 may not be separated downward, and thus, it is unnecessary to support the second flow guide 260.

The second blower 200 may further include the second air current changing fin 280 provided at an upper side of the second discharge guide, to change the flow of air discharged from the second discharge guide to a lateral direction. The second air current changing fin 280 may have a ring shape, and a lower surface of the second air current changing fin 280 may include an inclined surface extending upward toward the outside. The flow direction of air discharged upward from the second discharge guide may be changed to the lateral direction by the inclined surface of the second air current changing fin 280.

A lower surface of the first air current changing fin 180 and an upper surface of the second air current changing fin 280 may be coupled to each other. An upper surface of the first air current changing fin 180 and a lower surface of the second air current changing fin 280 may be coupled by insertion coupling between a rib and a groove.

As the first air current changing fin 180 and the second air current changing fin 280 are coupled to each other, the first blower 100 and the second blower 200 may constitute one device. The first air current changing fin 180 and the second air current changing fin 280 may be commonly referred to as "air current changing fins."

Figure 19:
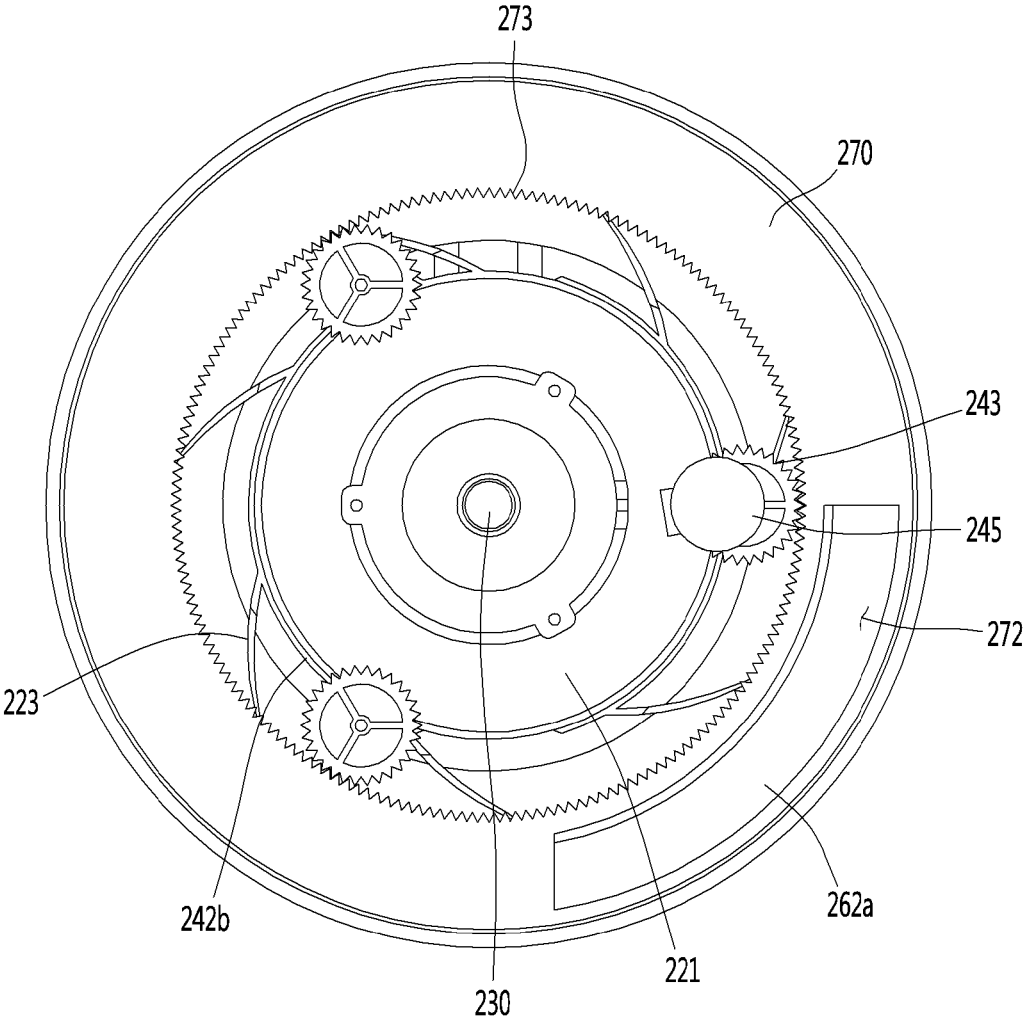
FIG. 19 is a front view showing a coupling state between a second pinion gear and a second rack gear of the second blower according to an embodiment.
Figure 20:
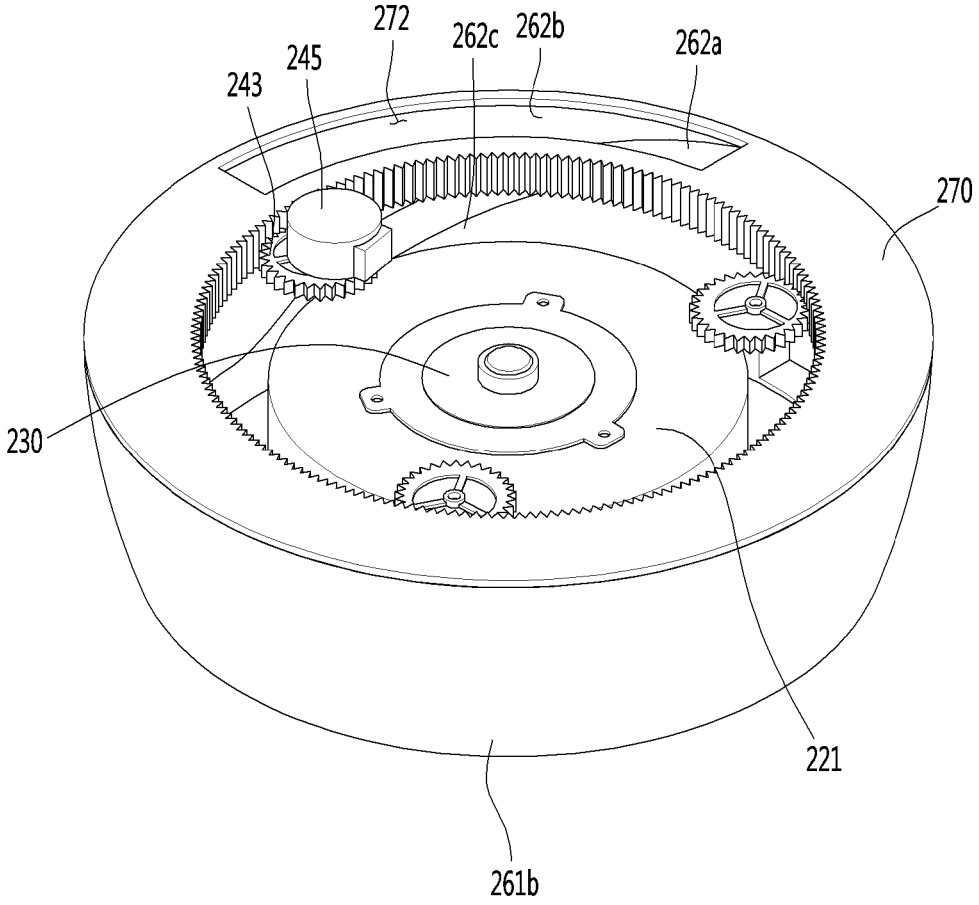
FIG. 20 is a perspective view showing the coupling state between the second pinion gear and the second rack gear of the second blower according to an embodiment.

Referring to FIGS. 19 and 20, some of the plurality of second pinion gears 243 coupled to the lower fan housing 240 may be exposed to the outside of the lower fan housing 240. If the second discharge guide is coupled to the lower fan housing 240, the second rack gear 273 may be gear-coupled to the second pinion gear 243.

If the second pinion gear 243 is rotated as the first gear motor 145 coupled to any one of the plurality of second pinion gears 243 is driven, the second rack gear 273 may be rotated by the second pinion gear 243. As the second rack gear 273 is rotated, the second discharge outlet 270 may be rotated, and the second flow guide 260 coupled to the second discharge outlet 270 may also be rotated.

The second flow guide 260 and the second discharge outlet 270 may be rotated by 360 degrees in the circumferential direction. Accordingly, air introduced through the lower suction inlet 210 may be discharged in the lateral direction along the rotation direction of the second flow guide 260 and the second discharge outlet 270.

When the blower is driven, the filter may be operated anytime. Conversely, the heater may be operated only when the first air current and the second air current are joined together and then discharged. Referring to FIG. 21, the first air current A, the second air current B, and the discharge air current C may be generated in the body 10 of the blower according to the embodiment.

The first air current A may be an air current in which air at an upper side of the body 10 is introduced through the upper suction inlet 110 provided at an upper portion of the first blower 100 and then discharged through the first discharge outlet 170. If the upper fan 120 is rotated, air may be introduced through an upper end of the upper suction inlet 110. The introduced air may flow in the outer lower direction by the upper fan 120 and then may be discharged to a lower end of the first blower 100 through the first flow guide 160 and the first discharge outlet 170. Such an air current may form the first air current A.

The second air current B may be an air current in which air at a lower side of the body 10 is introduced through the lower suction inlet 210 provided at a lower portion of the second blower 200. If the lower fan 220 is rotated, air may be introduced through a lower end of the lower suction inlet 210. The introduced air may flow in an outer upper direction due to the lower fan 220 and then may be discharged to an upper end of the second blower 200 through the second flow guide 260 and the second discharge outlet 270. Such an air current may form the second air current B.

The first air current A and the second air current B may flow in opposite directions such that the first air current A and the second air current B approach each other, that is, toward a center of the body 10 based on the vertical direction. When the first air current A and the second air current B are discharged to the outside of the body 10, the first air current A and the second air current B may be joined together to form the discharge air current C. The first air current A discharged to the lower end of the first blower 100 and the second air current B discharged to the upper end of the second blower 200 may be joined together as the flow of air is changed by the current changing fins 180 and 280.

The discharge direction of the discharge air current C may be determined by a difference in air volume between the first air current A and the second air current B. For example, if an air volume of the first air current A is greater than an air volume of the second air current B, the discharge direction of the discharge air current C may be toward an outer lower direction. On the other hand, if the air volume of the second air current B is greater than the air volume of the first air current A, the discharge direction of the discharge air current C may be toward the outer upper direction.

When the first and second discharge outlets 170 and 270 are rotated in the same direction while the first and second blowers 100 and 200 are rotated in one direction, the discharge air current C may be generated as the first air current A and the second air current B are joined together. On the other hand, when the first and second discharge outlets 170 and 270 are rotated in different directions while the first blower 100 is rotated in a first direction and the second blower 200 is rotated in an opposite direction, the first air current A and the second air current B may discharge air in different directions.

The heater may be operated only when the discharge air current is generated. This is because, when the first air current A and the second air current B discharge air in different directions, the first air current A discharges cool air and the second air current B discharges warm air, and therefore, a performance efficiency of the blower may be degraded.

A blower according to embodiments is provided that may include an upper suction part or inlet having a first suction opening formed therein; a lower suction part or inlet having a second suction opening formed therein; at least one fan provided between the upper suction part and the lower suction part, to generate a flow of air; a discharge part or outlet disposed at an outer side of the fan to discharge air to the outside; a filter device or filter disposed or provided at any one of the upper suction part or the lower suction part, to filter suctioned air; and a heater device or heater disposed or provided at the other of the upper suction part or the lower suction part, to heat suctioned air. The filter device may be disposed or provided in the first suction opening, and the heater device may be disposed or provided in the second suction opening.

The fan may include an upper fan that generates a first air current which is suctioned through the upper suction part, then discharged; and a lower fan disposed or provided at a lower side of the upper fan, wherein the lower fan generates a second air current which is suctioned through the lower suction part, and then discharged. The filter device may filter the first air current, and the heater device may heat the second air current.

The filter device may include a filter mounting part or mount disposed or provided at a lower side of the upper suction part, the filter mounting part including a filter mounting part with a size corresponding to a size of the first suction opening, and a filter inserted and coupled into the filter mounting part, to filter air. The heater device may include at least one heat source, and fixing parts respectively formed at both ends of the heat source, to fix the heat source to the lower suction part.

Heater mounting parts or mounts coupled to the fixing parts may be provided at both sides of the lower suction part, respectively. The fixing part may include a first fixing part or mount protruding in an extending direction of the heat source from each of both the ends of the heat source, and a second fixing part or mount extending in a direction perpendicular to the extending direction of the heat source from the first fixing part.

The heater mounts may each include an insertion groove having a width corresponding to a width of the first fixing part, the insertion groove having the first fixing part or mount coupled thereto. The blower may further include a grill provided at an inner circumferential surface of the lower suction part, to shield the second suction opening. The grill may be formed of a metallic material. The blower may further include a first blower shell that accommodates the upper fan therein and a second blower shell that accommodates the lower fan therein. The first and second blower shells may be rotatably provided.

If the first and second blower shells are rotated in a first direction, a discharge direction of the first air current and a discharge direction of the second air current may be identical to each other, and the first and second air currents may be joined together to form a discharge air current. If the first blower shell is rotated in the first direction and the second blower shell is rotated in a second direction, the discharge direction of the first air current and the discharge direction of the second air current may be opposite to each other. The heater may be operated when the discharge air current is formed, and may not be operated when the discharge direction of the first air current and the discharge direction of the second air current are opposite to each other.

The blower according to the embodiments configured as described above may have at least the following advantages. First, as the blower may discharge cool air in summer and discharge warm air in winter, the blower may be used in four seasons. Second, foreign substances, such as fine dust, may be filtered from air through the filter device in the blower, and the filtered air may be discharged. Accordingly, the blower may discharge wind without damaging a health of users. Third, as the heater is provided at a lower portion of the body, a user may not be injured by the heater device even when the user manipulates the body.

Regarding the reference numerals assigned to the components in the drawings, it should be noted that the same components may be designated by the same reference numerals, wherever possible, even though they are shown in different drawings. Also, in the description of embodiments, specific description of known related configuration or functions may be omitted when it is deemed that such description may cause ambiguous interpretation of the present disclosure.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). In a case where it is described that any component is "connected" or "coupled" to another component, the component may be directly or indirectly connected or coupled to another component. However, it is to be understood that another component may be "connected" or "coupled" between the components.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a first suction inlet having a first suction opening formed therein;

a second suction inlet having a second suction opening formed therein;

at least one fan provided between the first suction inlet and the second suction inlet to generate a flow of air, wherein the at least one fan includes:

a first fan that generates a first air current which is suctioned through the first suction inlet; and a second fan provided at a second side of the first fan, wherein the second fan generates a second air current which is suctioned through the second suction inlet;

a discharge outlet provided at an outer side of the at least one fan to discharge air to an outside of the blower;

a filter provided at any one of the first suction inlet or the second suction inlet, to filter suctioned air;

a heater provided at the other of the first suction inlet or the second suction inlet to heat suctioned air;

a first blower shell that accommodates the first fan therein; and a second blower shell that accommodates the second fan therein, wherein the first and second blower shells are rotatably provided.

2. The blower of claim 1, wherein the filter is provided in the first suction opening, and the heater is provided in the second suction opening.

3. The blower of claim 2, wherein the filter filters the first air current, and the heater heats the second air current.

4. The blower of claim 1, wherein, when the first and second blower shells are rotated in a first direction, a discharge direction of the first air current and a discharge direction of the second air current are identical to each other, and the first and second air currents are joined together to form a discharge air current.

5. The blower of claim 4, wherein, when the first blower shell is rotated in the first direction and the second blower shell is rotated in an opposite direction, the discharge direction of the first air current and the discharge direction of the second air current are opposite to each other.

6. The blower of claim 5, wherein the heater is operated when the discharge air current is formed, and is not operated when the discharge direction of the first air current and the discharge direction of the second air current are opposite to each other.

7. The blower of claim 1, wherein the first suction inlet is an upper suction inlet provided at a top of the blower, and the second suction inlet is a lower suction inlet provided at a bottom of the blower.

8. A blower, comprising:

a first suction inlet having a first suction opening formed therein;

a second suction inlet having a second suction opening formed therein;

at least one fan provided between the first suction inlet and the second suction inlet to generate a flow of air;

a discharge outlet provided at an outer side of the at least one fan to discharge air to an outside of the blower;

a filter provided at any one of the first suction inlet or the second suction inlet, to filter suctioned air; and a heater provided at the other of the first suction inlet or the second suction inlet to heat suctioned air, wherein the heater includes:

at least one heat source; and fixing brackets respectively provided at both ends of the at least one heat source, to fix the at least one heat source to the second suction inlet, wherein a heater mount coupled to the fixing brackets is provided at both sides of the second suction inlet.

9. The blower of claim 8, wherein each of the fixing brackets respectively includes:

a first fixing bracket that protrudes from an end of the heat source in a first direction in which the heat source extends the heat source; and a second fixing bracket that extends from the first fixing bracket in a second direction perpendicular to the first direction.

10. The blower of claim 9, wherein each heater mount includes an insertion groove having a width corresponding to a width of the first fixing bracket and configured to receive the first fixing bracket.

11. The blower of claim 8, further including a grill provided at an inner circumferential surface of the second suction inlet to shield the second suction opening, wherein the grill is formed of a metallic material.

12. The blower of claim 1, wherein the filter includes:

a filter mount provided adjacent to the first suction inlet, the filter mount including a mounting hole having a size corresponding to a size of the first suction opening; and a filter material inserted and coupled into the mounting hole, to filter air.

13. The blower of claim 8, wherein the filter includes:

a filter mount provided adjacent to the first suction inlet, the filter mount including a mounting hole having a size corresponding to a size of the first suction opening; and a filter material inserted and coupled into the mounting hole, to filter air.

* * * * *